US005357275A

United States Patent [19]

Ikado et al.

[11] Patent Number: 5,357,275

[45] Date of Patent: Oct. 18, 1994

[54] INK JET RECORDING APPARATUS AND PUMP MECHANISM FOR USE THEREWITH

[75] Inventors: Masaharu Ikado; Yoji Ara, both of Yokohama, Japan

[73] Assignee: Canon Kabushiki Kaisha, Tokyo, Japan

[21] Appl. No.: 176,285

[22] Filed: Dec. 30, 1993

Related U.S. Application Data

[63] Continuation of Ser. No. 677,470, Mar. 29, 1991, abandoned.

[30] Foreign Application Priority Data

| | | | |
|---|---|---|---|
| Mar. 30, 1990 | [JP] | Japan | 2-081086 |
| Apr. 11, 1990 | [JP] | Japan | 2-095407 |
| Apr. 11, 1990 | [JP] | Japan | 2-095481 |
| Apr. 11, 1990 | [JP] | Japan | 2-095978 |

[51] Int. Cl.[5] ..... B41J 2/165

[52] U.S. Cl. ..... 347/31

[58] Field of Search ..... 346/75, 140 R; 400/126

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,383,263 | 5/1983 | Ozawa et al. | 346/140 R |
| 4,410,900 | 10/1983 | Terasawa | 346/140 R |
| 4,437,105 | 3/1984 | Mrazek et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,600,931 | 7/1986 | Terasawa | 346/140 R |
| 4,631,554 | 12/1986 | Terasawa | 346/140 R |
| 4,723,129 | 2/1988 | Endo et al. | 346/1.1 |
| 4,740,796 | 4/1988 | Endo et al. | 346/1.1 |
| 4,825,231 | 4/1989 | Nozaki | 346/140 R |
| 4,951,066 | 8/1990 | Teresawa et al. | 346/140 R |
| 4,970,534 | 11/1990 | Terasawa et al. | 346/140 R |

FOREIGN PATENT DOCUMENTS

| | | |
|---|---|---|
| 0375407 | 6/1990 | European Pat. Off. . |
| 3040055 | 5/1981 | Fed. Rep. of Germany . |
| 3725673 | 2/1988 | Fed. Rep. of Germany . |
| 59-123670 | 7/1984 | Japan . |
| 59-138461 | 8/1984 | Japan . |

*Primary Examiner*—Benjamin R. Fuller
*Assistant Examiner*—N. Le
*Attorney, Agent, or Firm*—Fitzpatrick, Cella, Harper & Scinto

[57] ABSTRACT

A pump mechanism of an ink jet recording apparatus comprises a pump having a suction portion for sucking from a sucked member, said pump switching between the suction and non-suction operation of the suction portion by a reciprocating motion of a piston within a cylinder, without having a valve, a carrying member connected to said pump for carrying waste ink from said pump said carrying member opening to the atmosphere and a prevention mechanism for preventing a backflow of ink within said pump from the suction portion of said pump, to the outside of said pump which is caused by the reciprocating motion of the piston said prevention mechanism being an internal pump mechanism.

76 Claims, 16 Drawing Sheets

INK JET RECORDING APPARATUS AND PUMP MECHANISM FOR USE THEREWITH

This application is a continuation of application Ser. No. 07/677,470 filed Mar. 29, 1991, now abandoned.

BACKGROUND OF THE INVENTION

1. Field of the Invention

The present invention relates to an ink jet recording apparatus, and more particularly to an ink jet recording apparatus comprising a pump mechanism for sucking waste ink.

2. Related Background Art

A recording apparatus such as a printer, a copying machine or a facsimile terminal equipment is constituted to record an image consisting of dot patterns onto a recording medium such as a paper or plastic sheet, based on image information.

The recording apparatus can be classified as an ink jet, wire dot-matrix, thermal or laser beam system. According to the ink jet system (ink jet recording apparatus) the ink is discharged from a recording head for depositing ink onto a recording medium.

This ink jet recording apparatus is a nonimpact type having such features as low noise, high-density and high-speed recording ability, and is given color image recording capability by the use of color inks.

In the ink jet recording apparatus as described above waste ink may sometimes collect on a discharge port face of a recording head due to a fine mist of ink floating with a recording medium, or the splashing of discharged ink from the recording medium.

If waste ink as mentioned above may adhere to the discharge port face of the recording head, the ink discharge direction or speed may change, or the particle sizes of discharged ink droplets may be dispersed, so that the quality of recording may be decreased.

As means for preventing such a phenomenon, an ink jet recording apparatus is provided with a suction station for sucking waste ink as above described.

However, in a conventional ink jet recording apparatus, a pump for the suction station is provided with a valve which opens or closes, in which waste ink is sucked by a piston reciprocating within a cylinder. The pump with such a constitution had a problem in that the repeating mechanism of the valve might malfunction due to ink collected on it. However, since few troubles originating from the problem occurred, a fundamental resolution was not achieved.

Thus, the present inventors examined a constitution in which contact members are used for the valve function, thereby eliminating the open/close valve mechanism, but a new problem occurred. That is, there is an advantage that this embodiment's construction is simple, (but the fouling due to collected ink becomes conspicuous within the apparatus.) This fouling was often seen particularly on a head surface within a cap. A detailed examination of this phenomenon by a present inventor showed that a back flow from the inside of the pump toward the cap is generated.

SUMMARY OF THE INVENTION

An object of the present invention is to provide a reliable ink jet recording apparatus by devising a suction station and an ink absorbing system in order to consider and resolve conventional technical problems as previously described.

Another object of the present invention is to provide a reliable ink jet recording apparatus comprising a waste ink back flow prevention mechanism in which waste ink does not flow backward.

Still another object of the present invention is to provide a reliable ink jet recording apparatus comprising an ink meniscus depression prevention mechanism in which the meniscus will not be depressed by the cap.

Yet another object of the present invention is to provide an ink jet recording apparatus comprising a pump having a suction portion for sucking from a sucked member, and switching the suction or non-suction from said suction portion by the reciprocating motion of a piston within a cylinder, without having a valve, a carrying member for carrying waste ink from said pump, which is connected to said pump and opens to the atmosphere, and a prevention mechanism within a pump internal mechanism for preventing a back flow of ink within the pump from said suction portion of said pump to the outside of said pump, which is caused by the reciprocating motion within said cylinder.

Another object of the present invention is to provide an ink jet recording apparatus comprising a recording head for recording onto a recording member, a plurality of consecutive waste ink absorbing members for absorbing the ink adhering to a cleaning member for cleaning a discharge port face of said recording head, a pump having a suction portion for sucking from a sucked member, and switching the suction or non-suction from said suction portion by the reciprocating motion of a piston within a cylinder, without having a valve, a carrying member, for carrying waste ink from said pump, which is connected to said pump and opens to the atmosphere, and a prevention mechanism within a pump internal mechanism for preventing a back flow of ink within the pump from said suction portion of said pump to the outside of said pump, which is caused by the reciprocating motion within said cylinder.

Another object of the present invention is to provide an ink jet recording apparatus comprising a recording head for recording onto a recording member, a pump having a suction portion for sucking from a sucked member, and switching the suction or non-suction from said suction portion by the reciprocating motion of a piston within a cylinder, without having a valve, a carrying member for carrying waste ink from said pump, which is connected to said pump and opens to the atmosphere via a plurality of opening portions provided within a conveying roller, and a prevention mechanism within a pump internal mechanism for preventing a back flow of ink within the pump from said suction portion of said pump to the outside of said pump, which is caused by the reciprocating motion within said cylinder.

DETAILED DESCRIPTION OF THE PREFERRED EMBODIMENTS

The present invention will be described specifically with reference to the drawings.

Figure 1:
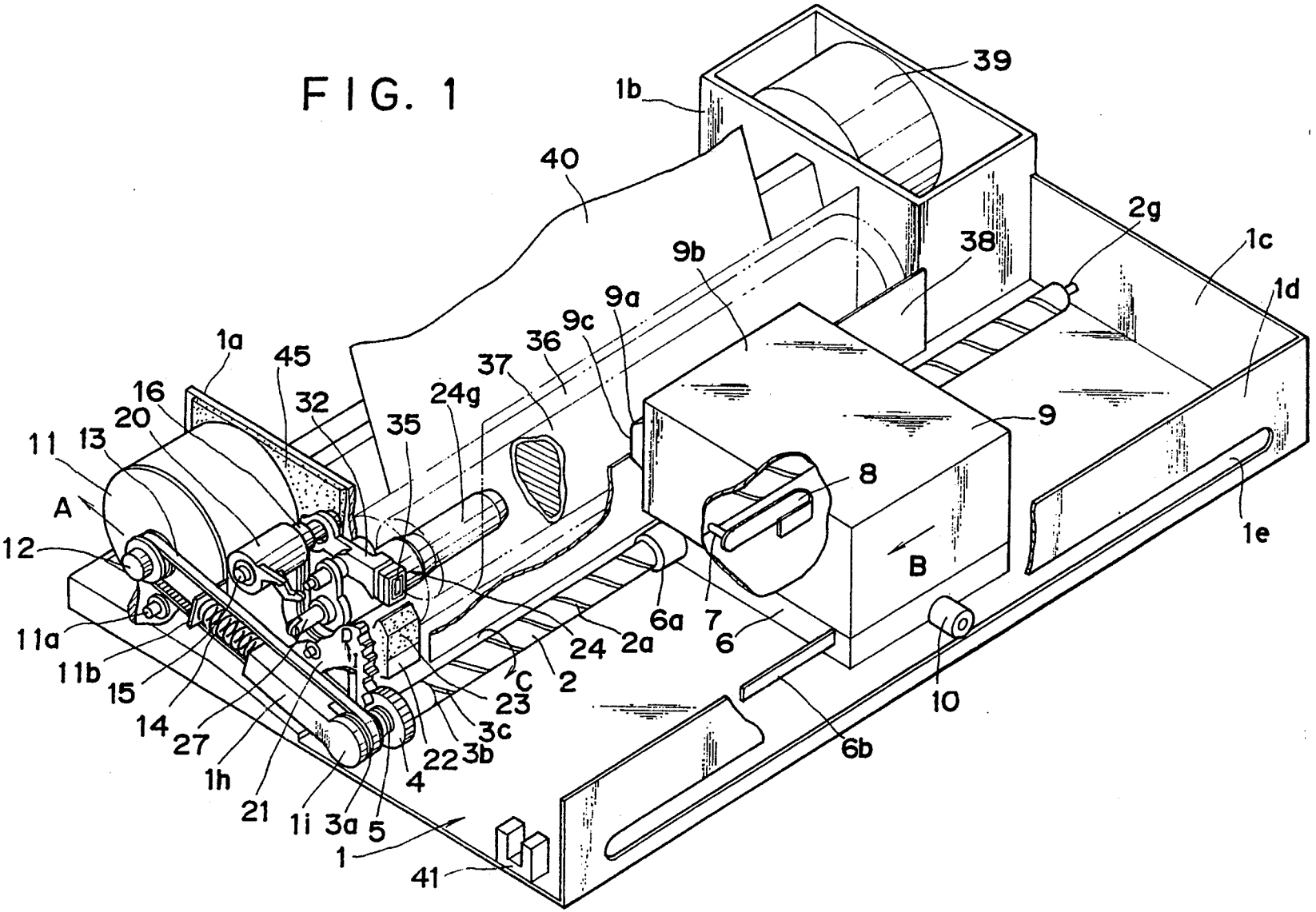
FIG. 1 is a perspective view, partially broken away, showing a constitution for essential parts of an ink jet recording apparatus to which the present invention is preferably applicable.

FIG. 1 is a perspective view showing a constitution for essential parts of an ink jet recording apparatus to which the present invention is preferably applicable.

In FIG. 1, 1 is a chassis at the back of which are a left-hand plate 1*a* and a right-hand plate 1*b* which also serve as the guide for a recording medium 40, on a right-hand end portion of which is stood a front side plate 1*c*, and on a front portion of which is a carrier guide plate 1*d*.

The carrier guide plate 1*d* as described above is formed with a slot 1*e* for guiding a carrier 6, a guide roller 10 of which can slide within the slot 1*e*.

The chassis 1 as above described is formed with a motor mounting hole (not shown) on which a carrier motor 11 for driving the carrier 6 is mounted.

At a predetermined position on a left-hand end portion of the chassis 1 as described is fixed a lead arm 1*h*, at a tip portion of which is provided a bearing portion 1*i* for rotatably bearing a lead screw 2 for driving the carrier, as well as supporting it in the axial and radial directions.

The lead screw 2 as above described is formed with a lead groove 2*a* of a predetermined pitch.

A lead pulley 3*a* is fixed on a carrier home position side of the lead screw 2 as above described, and a circumferential groove (recovery groove) 3*b* perpendicular thereto and useful for the recovery operation is formed at a capping position in the neighborhood of a home position of the lead screw 2, wherein the lead groove 2*a* and the recovery groove 3*b* as above described are connected via a lead-in groove 3*c*.

Shanks 2*g* formed on both ends of the lead screw 2 are fitted into the bearing portion 1*i* of the load arm 1*h* in the chassis 1 and a bearing portion provided on the front side plate 1*c*, so as to bear thereon in free rotation.

Note that the shanks 2*g* of the lead screw 2 are biased toward the thrust directions by leaf springs, not shown.

Between the lead pulley 3*a* of the lead screw 2 and the recovery groove 3*b*, a clutch gear 4 is mounted integrally in the rotational direction, and slidably in the axial direction.

The clutch gear 4 is urged toward the lead groove 2*a* by a clutch spring 5.

The carrier 6 is slidingly mounted on the lead screw 2, and provided with a presser portion 6*a* for pressing an end face of the clutch gear 4, and a detector strip 6*b* for detecting a home position.

A lead pin 7 is guided and supported in a guide hole (not shown) formed on the carrier 6 for the engagement with the lead groove 2*a* of the lead screw 2, and is biased into the lead groove 2*a* at a tip portion of a lead pin spring 8 attached to the carrier 6.

A recording head 9 is mounted on the carrier 6, in which the recording head 9 as shown is a cartridge type integral with an ink tank, having a discharge port face 9*a* on which discharge ports 9*c* are formed and an ink tank portion 9*b*.

The recording head 9 is an ink jet recording head for discharging ink by the use of heat energy, comprising electricity-heat converters for generating the heat energy.

Particularly, the ink jet recording head 9 as above described is one in which the recording is performed by discharging ink through discharge ports, by growth of bubble due to film boiling caused by the heat energy applied by the electricity-heat converters as above described.

A carrier roller 10 is attached for free rotation on a front face of the carrier 6, and rotatably fitted into the slot 1*e* on the chassis 1.

The carrier motor 11, which is constituted of, for example, a pulse motor, bears on the chassis 1 by means of a pin 11*a* provided on a bottom portion thereof, and is mounted to be swingable in a direction as indicated by the arrow A around a bearing hole (not shown) of the chassis 11 bearing the pin 11*a*.

Further, a spring shoe 1 1*b* is formed integrally with the carrier motor 11, which is urged in the direction A by a compression spring 14 attached between the spring shoe 11*b* and the lead arm 1*h*.

A motor pulley 12 is secured on a motor shaft of the carrier motor 11, and a timing belt 13 is passed under tension between the motor pulley 12 and the lead pulley 3*a* secured onto the lead screw 2.

The timing belt 13 is tensioned by a spring force of the compression spring 14.

On the left side plate 1*a* of the chassis 1 is a set shaft 15 on which a blade lever 16 and a set lever 20 are rotatably mounted.

Figure 2:
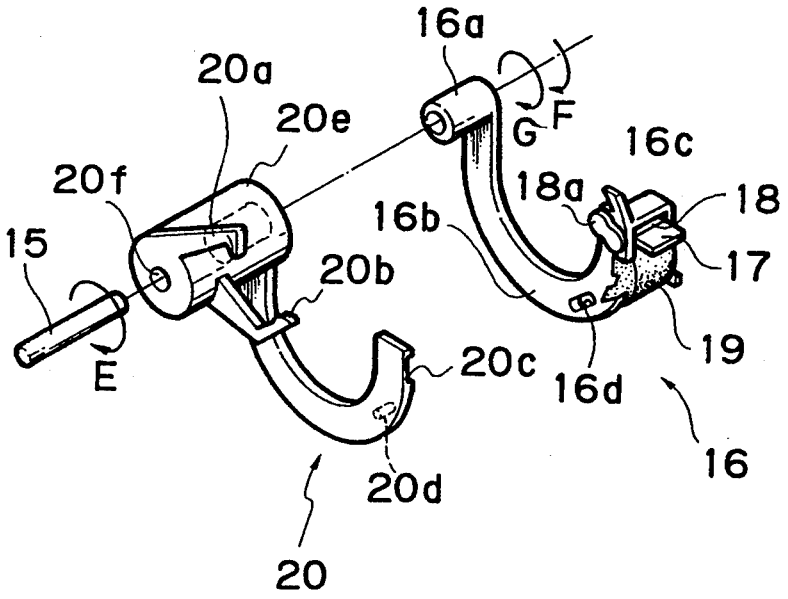
FIG. 2 is a perspective view of a set lever and a blade lever which bear on a set shaft as shown in FIG. 1.

FIG. 2 is a partial perspective view showing the blade lever 16 and the set lever 20 as above described.

In FIG. 2, the blade lever 16 has a boss portion 16*a* rotatably mounted on the set shaft 15 (via a boss portion 20*e* of the set lever 20 in the example as shown).

The set lever 20 is shaped like a bowed arm, with a top end of its arm portion 16*b* being formed with a hook portion 16*c*.

In the neighborhood of the top end of the arm portion 16*b* rotatably bears a blade shaft 18, to which a wiping blade (wiper) 17 is secured.

The wiper 17 is fabricated of an elastic material such as silicone rubber or CR rubber.

At one end of the blade shaft 18 as above described, an engaging portion 18*a* with which the wiper 17 is driven for rotaton (wiping operation) is integrally formed.

Immediately adjacent to an attaching portion for the wiper 17 in the arm portion 16*b*, an ink carrier 19, made of a hydrophilic porous material (plastic sintered compact, urethane foam, etc.), is mounted.

The ink carrier 19 is to receive and absorb the ink from discharge ports 9*c*, when the recording head 9 is driven for predischarge at a position opposed to the ink carrier 19.

Further, in the arm portion 16*b* (almost portion in the example as shown), a long aperture 16*d* is formed.

In the neighborhood of the boss portion of the set lever 20 are small arm portions 20*a*, 20*b* engaged by a cam portion of timing gear 21 (FIGS. 1 and 3) which as will be described later is disposed on a shaft disposed parallel to the set shaft 15.

A dowel 20*d* is provided in an intermediate portion of the set lever 20, and a hook portion 20*c* is formed in a top end of the set lever 20.

If the set lever 20 is rotated in conjunction with the rotation of the timing gear 21 as will be described later, the hook portion 20*c* of the set lever 20 engages the engaging portion 18*a* of the blade shaft 18, and further, the dowel 20*d* of the set lever 20 fits into the long aperture 16*d* of the blade lever 16.

Figure 4:
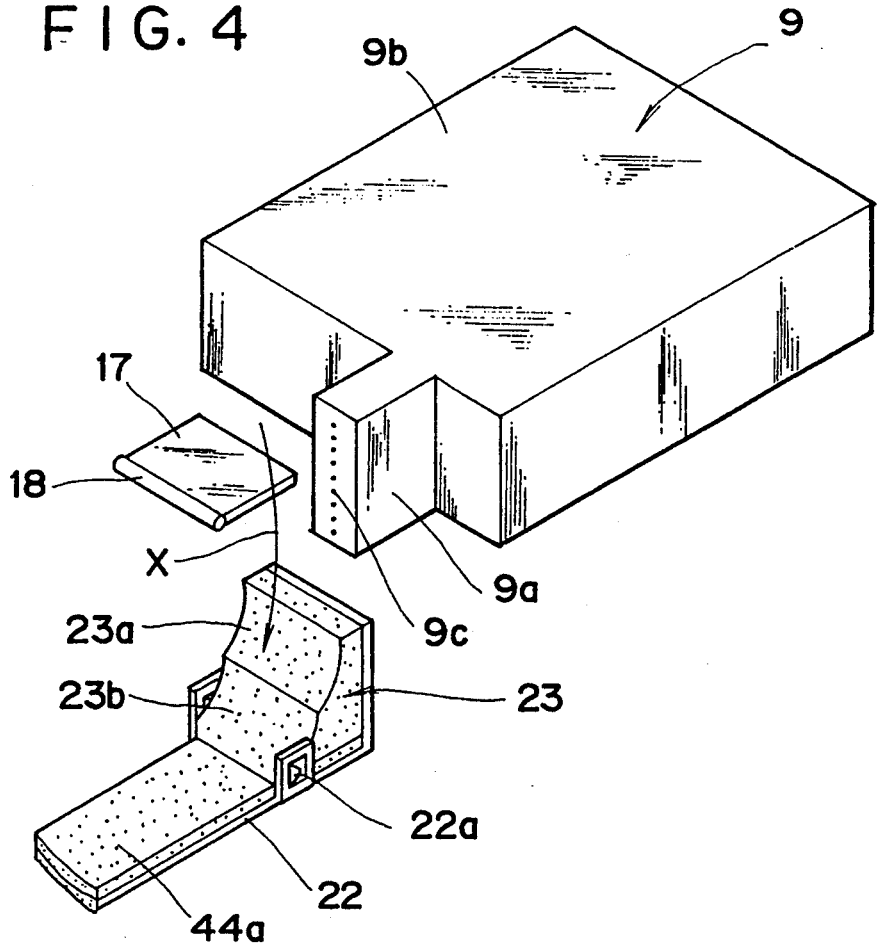
FIG. 4 is a partial perspective view typically showing the operation of a wiper as shown in FIG. 1.

Owing to the long aperture 16*d*, if the blade shaft 18 is rotated, the blade lever 16 is rotated around the set shaft 15, delayed by a predetermined time from the rotation of the set lever 20, so that a discharge port face 9*a* of the recording head 9 is wiped (wipe-over) by the movement of the wiper (wiping blade) 17 (in a direction as indicated by an arrow X in FIG. 4).

Note that in the shown example, a rotation hole 20*f* of boss portion 20*e* in the set lever 20 is rotatably fitted onto the set shaft 15, the boss portion 16*a* (central portion for rotation) of blade lever 16 is rotatably fitted into the rotation hole 20*f* of the set lever 20, with each portion being rotated around the set shaft 15.

On the chassis 1, a timing gear 21 engaged by a clutch gear 4 of the lead screw 2 is rotatably mounted around a shaft parallel thereto.

Figure 3:
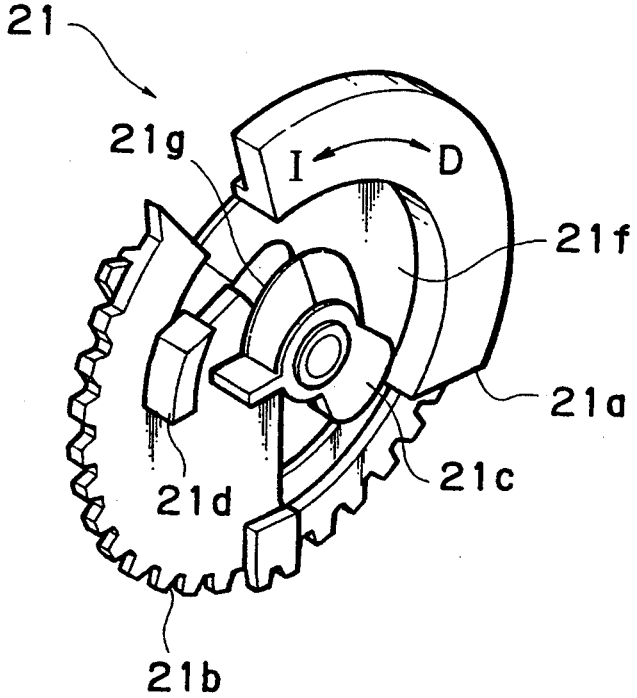
FIG. 3 is a perspective view of a timing gear as shown in FIG. 1.

FIG. 3 is a perspective view showing the timing gear 21.

The timing gear 21 controls the timing for the rotation of the set lever 20 and the blade lever 16, and for the operation of a discharge recovery pump and a cap for enclosing a discharge port face, as will be described later.

In FIG. 3, around an external periphery of the timing gear 21, a blade cam 21*a* engaged by small arm portions 20*a*, 20*b* of the set lever 20, and driving teeth 21*b* some of which are omitted are formed.

At a predetermined position of the timing gear 21, a cap cam A 21*c* and a cap cam B 21*d* for moving a cap lever 32 as will be described below a piston set cam (end face cam) 21*f* for pressing a piston 28 of a pump (FIG. 8) as will be described later, and a piston reset cam 21*g* for resetting the piston 28 spaced by a predetermined distance from the piston set cam 21*f* are integrally formed.

In FIG. 1, at a predetermined position in the neighborhood of a carrier home position of the chassis 1, an ink absorbing member spring 22 is attached, and at a top end thereof, an ink absorbing member 23 is attached which serves to pass the ink adhering to wiper (blade) 17, by the wiper 17 sliding in contact therewith.

The ink absorbing member 23 is connected to at least one waste ink absorbing member 45 disposed in a space within the chassis 1, by way of ink transfer members 44 as will be described below.

Figure 5:
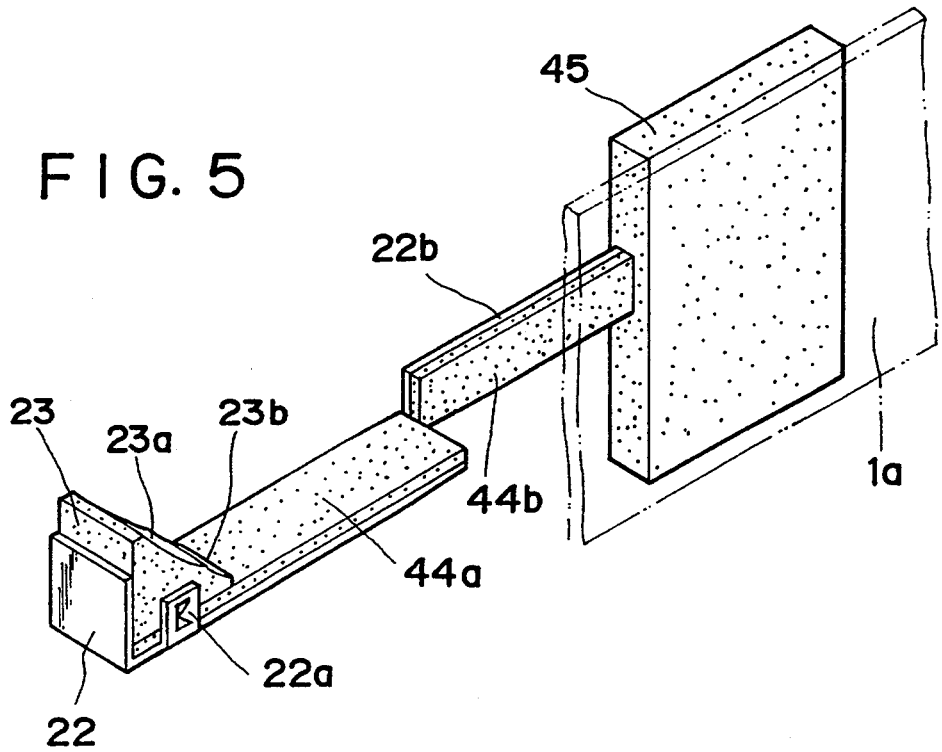
FIG. 5 is a perspective view showing a waste ink absorbing system as shown in FIG. 1.
Figure 6:
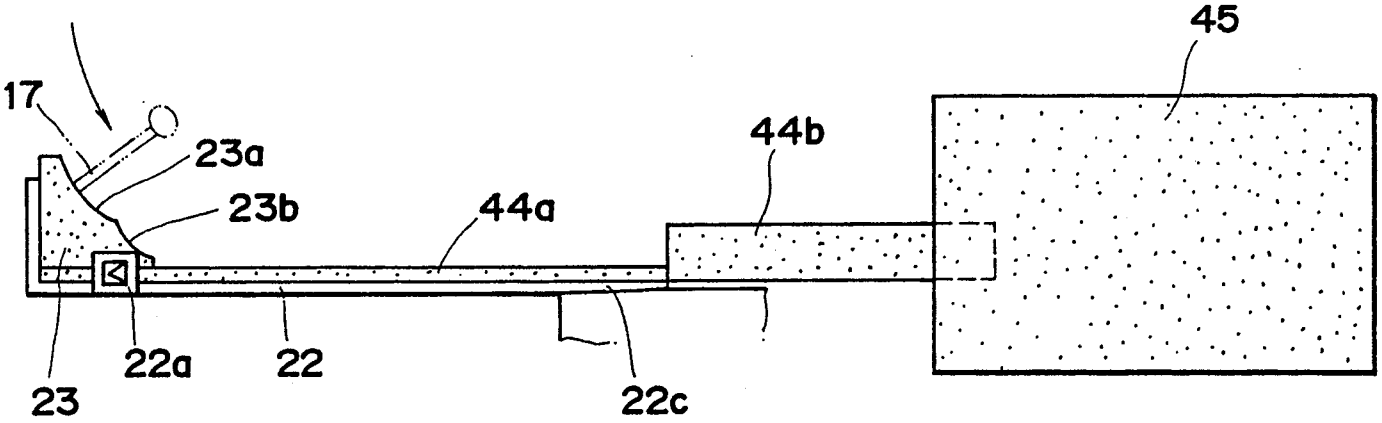
FIG. 6 is a longitudinal cross-sectional view of FIG. 5.
Figure 7:
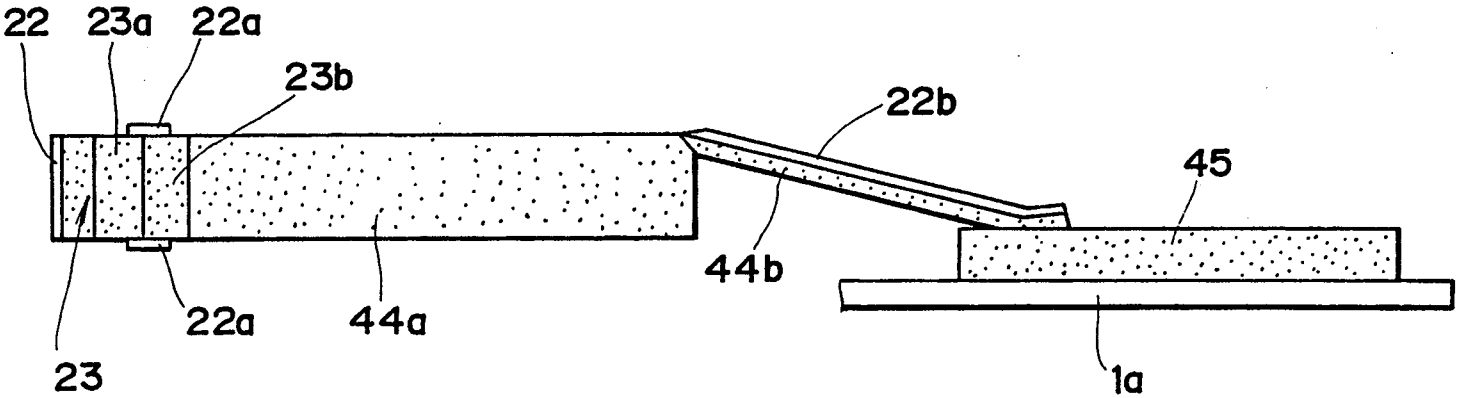
FIG. 7 is a plan view of FIG. 5.

FIG. 4 is a partial perspective view showing an arrangement of a discharge port face 9*a* of recording head 9, a wiper 17, and an ink absorbing member 23, FIG. 5 is a typical partial perspective view showing an arrangement of the ink absorbing member 23, the ink transfer members 44*a*, 44*b*, and a waste ink absorbing member 45, FIG. 6 is a longitudinal cross-sectional view of FIG. 5, and FIG. 7 is a plan view of FIG. 5.

The ink absorbing member spring 22 as above described is formed from a leaf spring of a predetermined length, fixed in a cantilevered state at its bottom portion 22 on the chassis 1, and a top portion at which the ink absorbing member 23 is attached is able to deform elastically.

An ink transfer member 44*a* is secured onto an upper face of the ink absorbing member spring 22 by adhesive or the like.

The ink absorbing member 23 is fixed to a predetermined position in the state of abutting a front end portion of the ink transfer member 44*a*, by an absorbing member holding portion 22*a* formed on a front end portion of the ink absorbing member spring 22.

On a surface of the carrier motor 11 on the left side plate 1*a* of the chassis 1, a waste ink absorbing member 45 is secured in a space between the left side plate 1*a* and the carrier motor 11, by adhesive or the like.

Note that in the example as shown, a strip-like connection member 22*b* leading to the waste ink absorbing member 45 is connected at a trailing end portion of the ink absorbing member spring 22, and a second ink transfer member 44*b*, having one end contact with the ink transfer portion 44*a* and the other end contact with the waste ink absorbing member 45, is secured on a surface of the connection member 22*b*.

Note that in the example as shown, the connection member 22*b* is connected twisted by approximately 90° with respect to the ink absorbing member spring 22, and the ink transfer members 44*a*, 44*b* are secured onto planar portions by adhesive or the like.

The ink absorbing member 23 is fabricated of a hydrophilic porous material, like the ink carrier 19 as previously described (FIG. 2).

The ink transfer members 44*a*, 44*b* and the waste ink absorbing member 45 are also fabricated of hydrophilic porous materials, for example, polyvinyl alcohol (PVA).

The ink absorbing member 23, the ink transfer members 44*a*, 44*b*, and the waste ink absorbing member 45 can be fabricated of a same material with a superior ink absorbency.

Thus, the ink imparted into the ink absorbing member 23 is transferred into the waste ink absorbing member 45, by the capillary action of the ink transfer members 44*a*, 44*b*, without saturating the ink absorbing member 23.

The ink absorbing member 23 is formed with a wipe-over portion 23*a* of circular face with which the wiper 17 as previously described is brought into close contact, and in a lower portion thereof, further formed with an absorbing face 23*b* of circular surface for passing the ink adhering to the ink carrier 19 with which the ink carrier 19 as previously described (FIG. 2) for receiving predischarged ink is brought into close contact.

Note that the absorbing member holding portion 22*a* of ink absorbing member spring 22 is urged upward by a slight amount of spring force, and made stationary at a predetermined position by a stopper, not shown.

Thereby, when the wiper 17 and the ink carrier 19 are to be placed in close contact, the ink absorbing member 23 always make contact by moving slightly downward with an elastic deformation of the ink absorbing member spring 22.

Note that in this example, the ink transfer members 44*a*, 44*b* are connected in series, and the ink absorbing member 23 is connected to one waste ink absorbing member 45 so as to be able to transfer the ink, whereas with the ink transfer members 44 (generically showing 44*a*, 44*b*) connected in parallel or net as appropriate, the ink absorbing member 23 can be connected to a plurality of waste ink absorbing members 45 to be able to transfer the ink.

Next, a recovery unit of ink jet recording apparatus as shown in FIG. 1 will be described in the following.

Figure 8:
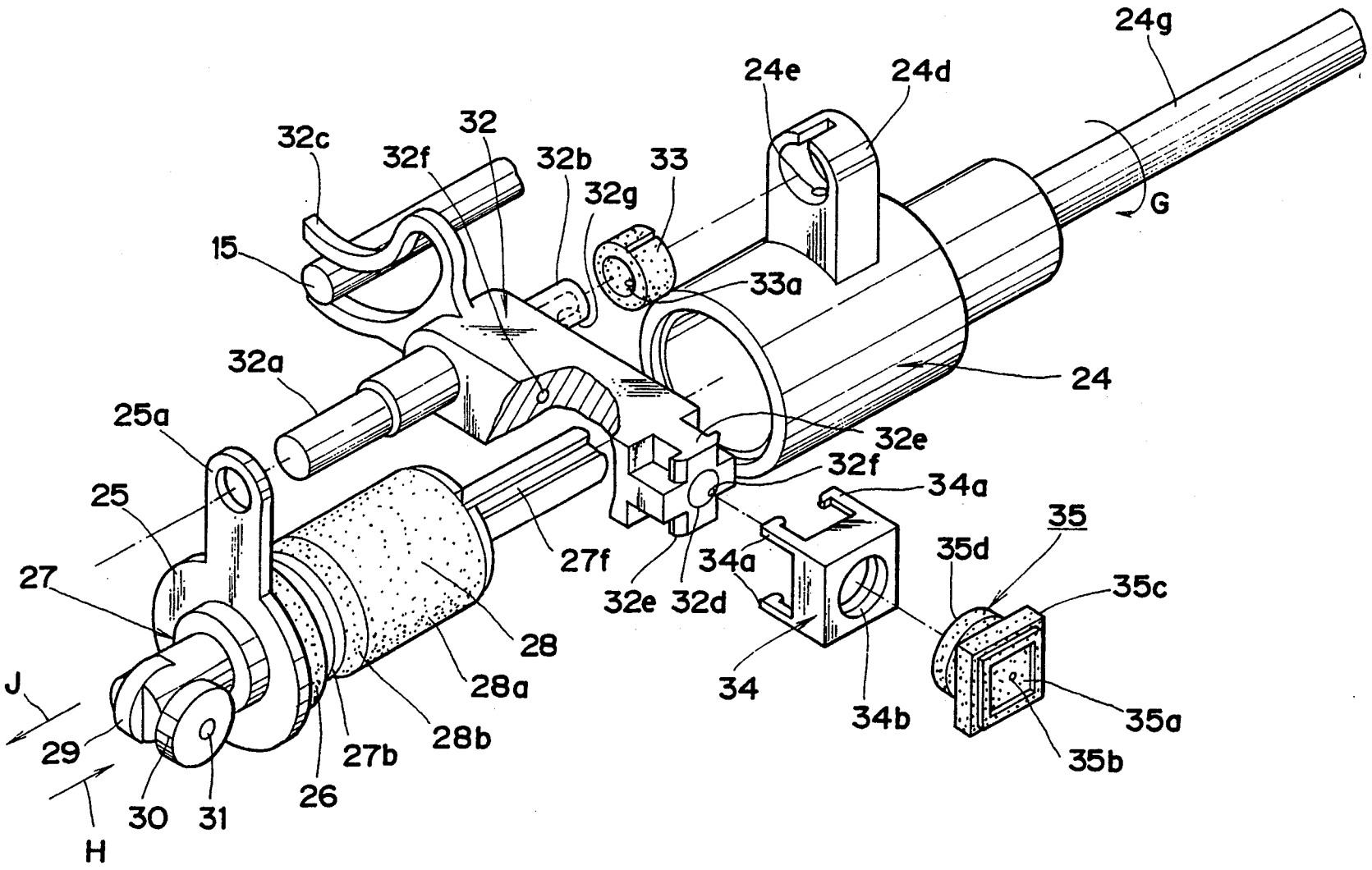
FIG. 8 is an exploded perspective view of a recovery pump and a cap as shown in FIG. 1.
Figure 9:
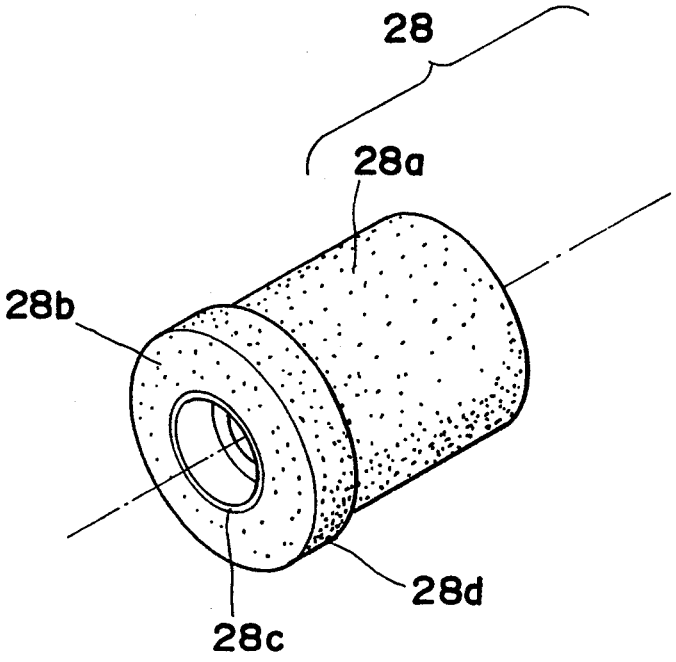
FIG. 9 is a perspective view of a piston unit as shown in FIG. 8.
Figure 10:
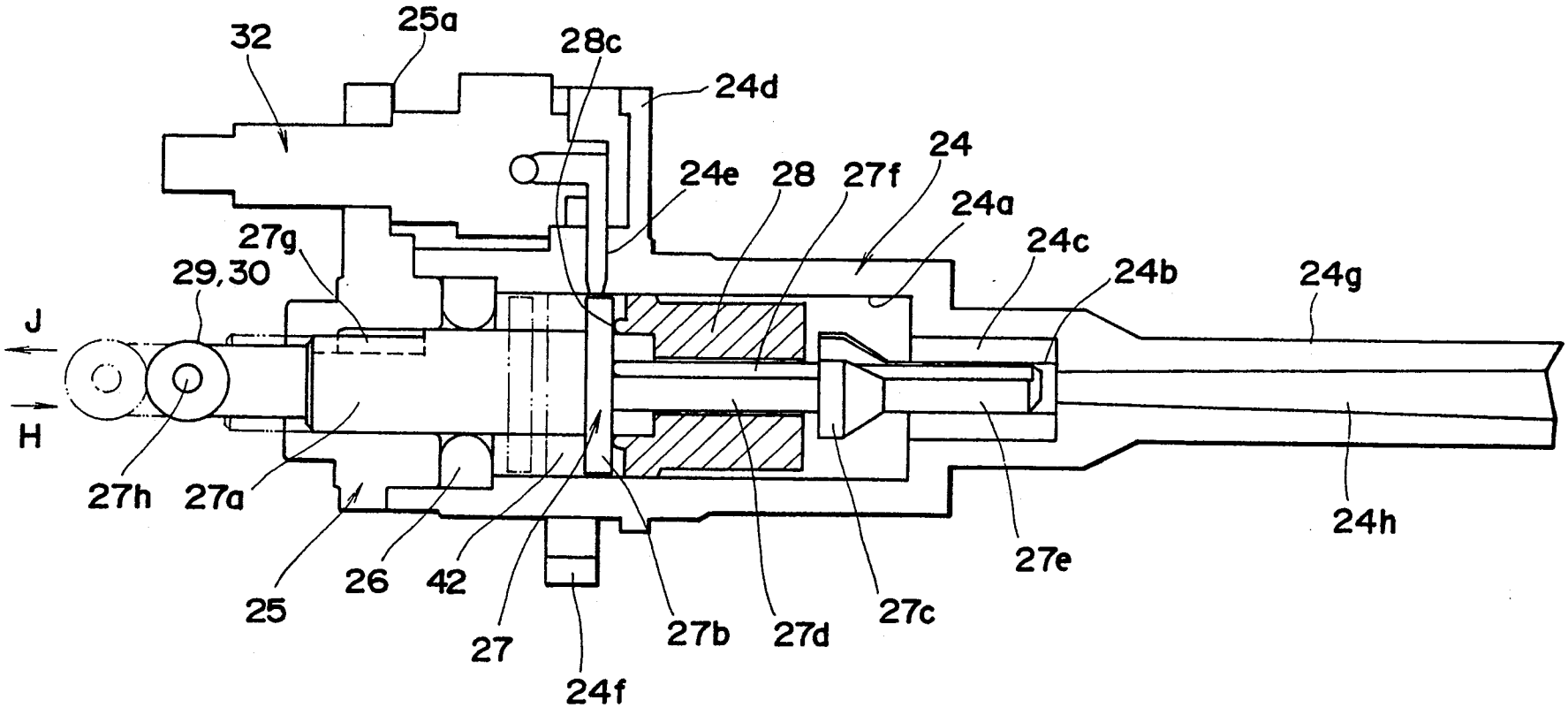
FIG. 10 is a longitudinal cross-sectional view of the pump as shown in FIG. 8.
Figure 11:
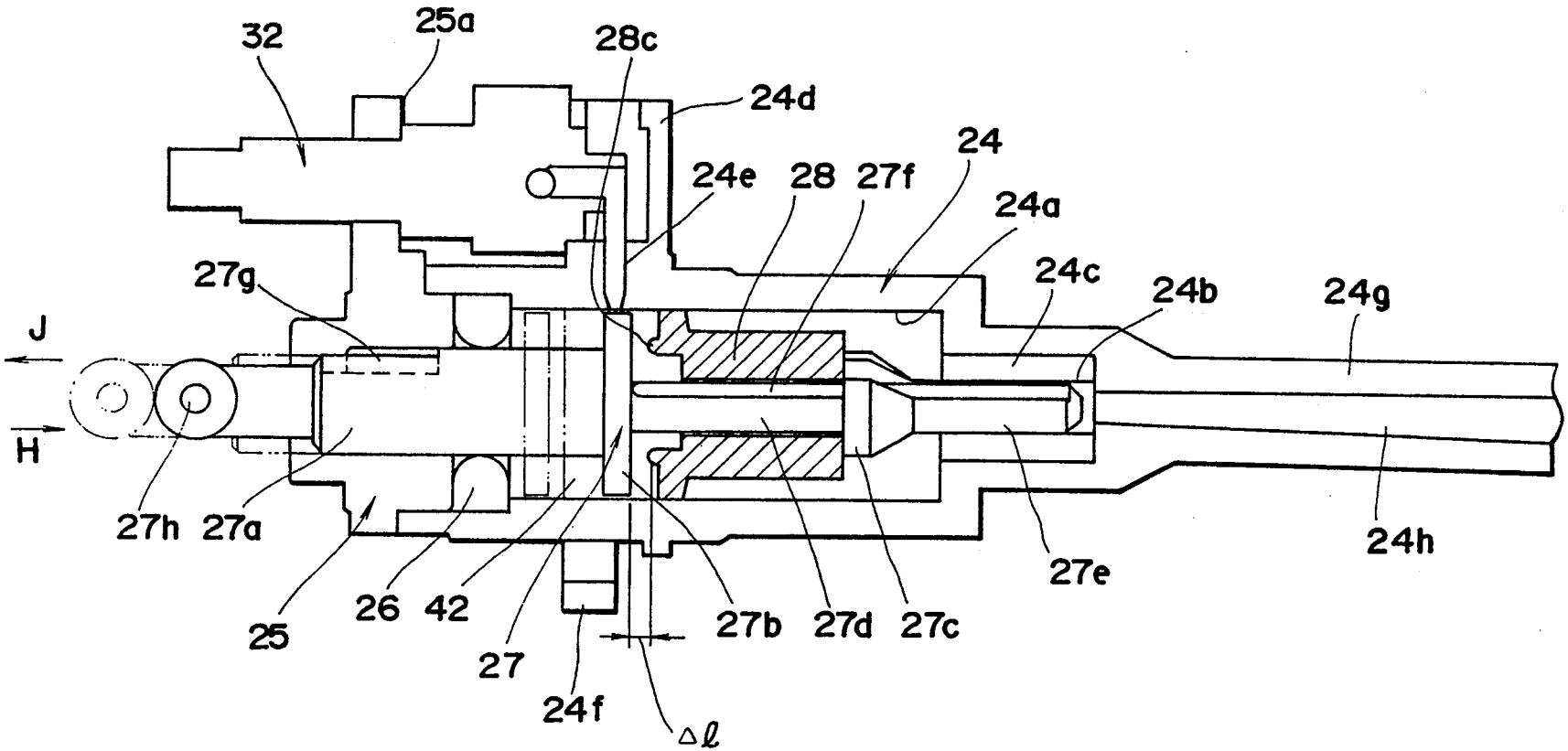
FIG. 11 is a longitudinal cross-sectional view of the pump as shown in FIG. 8, when the piston is positioned at an upper dead center.

FIG. 8 is an exploded perspective view showing a pump for recovering discharge as shown in FIG. 1, FIG. 9 is a perspective view of a piston unit as shown in FIG. 8, FIG. 10 is a longitudinal cross-sectional view of the pump as shown in FIG. 8, and FIG. 11 is a longitudinal cross-sectional view of the pump of FIG. 8, when a piston is located at an upper dead-center.

In FIGS. 8–11, a cylinder 24 of a pump comprises a cylinder portion 24*a* and a guide portion 24*b* for guiding a piston shaft 27, the guide portion 24*b* being formed with an ink flow path 24*c* consisting of an axial channel.

The cylinder 24 has a cap lever carrier 24*d* projected therefrom, into which a lever seal 33 can fit, and an ink flow path 24*e* formed therein which opens to a predetermined position.

Also, the cylinder 24 is integrally formed with a rotation lever 24*f* for receiving the rotation force (spring force) with a cap spring 43, in a direction where a cap 35 intimately encloses the discharge port face 9*a*.

Further, at one end of the cylinder 24 is integrally formed a waste ink tube 24*g* inserted within the ink absorbing member 37 (FIG. 1) attached inside a feed roller 36 for conveying a recording medium 40.

24*h* indicates an ink flow path formed within the waste ink tube 24*g* as above mentioned.

A piston seal 26 is fitted into an opening portion at other end of the cylinder 24, and outside thereof a cylinder cap 25 having a lever guide 25*a* is fitted by insertion under pressure.

An internal diameter of the piston seal 26 is set at a slightly smaller dimension in order to obtain a predetermined pressure contact force against a peripheral face of the piston shaft 27.

In order to reduce the sliding force of piston shaft 27, a lubrication coating may be applied on a surface of the piston seal 26.

The piston shaft 27 is formed with an operation shaft 27*a*, a piston presser 27*b*, a piston carrier 27*c*, a connecting shaft 27*d* and a guide shaft 27*c* which are consecutive, and an axial channel 27*f* serving as an ink flow path leading to the ink flow path 24*h*.

Note that the operation shaft 27*a* is formed with an axial channel 27*g* for preventing the rotation, and a bearing hole 27*h* is formed on a projection-side end portion of the operation shaft 27*a*.

A piston 28 is slidably fitted into a cylinder portion 24*a* of the cylinder 24, where the piston 28 is made of a rubber material such as NBR, its outer diameter being formed slightly larger than an inner diameter of the cylinder portion 24*a*, and is adequately compressed when inserted into the cylinder portion 24*a*.

A piston presser roller 29 and a piston return roller 30 are rotatably mounted via a roller shaft 31 on a projecting end portion (bearing hole 27*h*) of the piston shaft 27.

On an upper side of the cylinder 24 is a rotatably attached cap lever 32 having its base ends carried by the cap lever carrier 24*d* and the lever guide 25*a*.

The cap lever 32 is attached orthogonally to the cylinder 24.

The cap lever 32 is carried by means of a rotation shaft 32*a* and an ink guide 32*b* projecting parallel to the cylinder 24 on both sides of its base ends.

Also, on the base ends of the cap lever 32, a lever guide 32*c* having a guide opening for guiding and engaging with the set shaft 15 is formed and projects backward.

Thus, the cap lever 32 is mounted for the approximate linear movement so as to enclose or uncover a discharge port face 9*a* of recording head 9 by rotation of the cylinder 24 around its shaft axis.

A convex spherical seal face 32*d* is provided on an end portion of the cap lever 32.

Further, above and below the end portion of the cap lever 32, an engaging portion 32*e* engaged by a hook 34*a* of cap holder 34 is provided.

An ink flow path 32*f* is formed inside the cap lever 32.

The ink flow path 32*f* is formed to open to a central portion of the seal face 32*d*, passing through the inside of the lever 32, bent at right angles on the base ends of the lever 32, passing through a center of the ink guide 32*b*, and open to a top end face of the ink guide 32*b*.

On a lower side of the ink guide 32*b* is formed a notch or communication aperture 32*g* loading to the ink flow path 32*f*.

The ink guide 32*b* is fitted into a bottomed hole in the cap lever carrier 24*d* of the cylinder 24, via a cylindrical lever seal 33 made of an elastic material such as a rubber.

The lever seal 33 is fitted by pressure into both the ink guide 32*b* and the cap lever carrier 24*d*.

The lever seal 33 is formed with a communication aperture 33*a* which communicates the notch 32*g* of the ink guide 32*b* with an ink flow path 24*e* formed almost radially in the cylinder 24.

Therefore, the ink flow path 32*f* within the cap lever 32 communicates via the communication aperture 33*a* into the ink flow path 24*e* of the cylinder 24.

The cap holder 34 is fixed on a top end portion of the cap lever 32, by means of engaging means composed of the hook 34*a* and the engaging portion 32*e*.

At a central portion of the cap holder 34 is formed an opening 34*b* for attaching a cap 35.

The cap 35, made of a rubber-like elastic material, is to prevent a normal ink from being dry, by enclosing a discharge port face 9*a* of the recording head 9 when not recording.

A suction port 35*a* is formed within the cap 35, and communicates via an ink flow path internally provided into an opening in a central portion at back side of the cap 35.

At the back side of the cap 35 is formed a flange portion for fixing the cap to the opening 34*b* of cap holder 34.

In an assembled state where the cap 35 is attached to the cap holder 34, and the cap holder 34 is attached to the cap lever 32, a suction port 35*a* of the cap 35 is hermetically communicable to the ink flow path 32*f* of cap lever 32 opening to the seal face 32*d*.

Returning to FIG. 1, a feed roller 36 for conveying a recording medium 40 is one in which, for example, an elastic coating (e.g., urethane resin) is applied on a surface of aluminum drawn tube.

A waste ink absorbing member 37 is attached inside the feed roller 36.

The waste ink absorbing member 37 is one made by filling an absorbing material of polyester cotton or the like into a plastic cylindrical case of polyethylene or EVA, with a better ink absorbency in the axial direction.

The waste ink absorbing member 37 has the waste ink tube 24*g* of the cylinder 24 inserted and fixed therein, whereby waste ink exhausted from the pump is introduced into the waste ink absorbing member 37.

The chassis 1 has a paper presser plate 38 mounted to closely press a recording medium 40 onto a peripheral face of the feed roller 36.

The feed roller 36 is controlled and driven via a reduction gear of a predetermined ratio by a paper feed motor 39.

At a predetermined position of the chassis 1, a home position detector 41 consisting of a transparent-type photointerrupter is installed, thereby enabling the detection of a home position of the carrier 6 with a detection stripe 6*b* intercepting a light path.

Note that numeral 42 in FIGS. 10 and 11 indicates a pump chamber of recovery pump.

Next, the operation of an ink jet recording apparatus with the above constitution will be described.

First, in a normal recording operation, the lead screw 2 is rotated via the timing belt 13 by rotation of the carrier motor 11, and the carrier 6 is moved for scan in the recording column direction via the lead pin 7 engaging the lead groove 2*a* of lead screw 2.

The carrier motor 11 is urged in the arrow A direction by the motor spring 14, so that the timing belt 13 is always tensioned.

Though inertial force is exerted in moving, starting or stopping the carrier 6, the load of motor spring 14 and the motor load can be sufficient with the lesser force because the weight of carrier motor 11 generates an inertia.

If an air or hydraulic damper is provided on a part of the motor spring 14, noise due to the vibration of a motor rotor in starting or stopping the carrier 6 can be reduced.

Note that an overshoot of motor 11 can be reduced by appropriately selecting the weights of motor 11 and carrier 6, and the damping coefficient of motor spring 14, so that the noise can be lowered.

In the discharge recovery operation, first, the carrier 6 is moved in the direction to a home position (direction indicated by an arrow B) until the home position detector 41 detects a predischarge position immediately before the home position, and if detected, the ink is predischarged to discharge some slightly thickened ink with a discharge force of recording head 9 for the recovery operation.

Note that at the predischarge position as above indicated, the lead pin 7 still engages the lead groove 2*a*, with discharge ports 9*c* being opposed to the ink carrier 19 (FIG. 2).

Periodical predischarges performed during normal recording to remove thickened ink around discharge ports 9*c* that are not discharging ink are also carried out at the predischarge position.

If the carrier 6 is moved in the arrow B direction by further rotating the lead screw 2, the presser portion 6*a* presses against the clutch gear 4, which thus moves in the arrow B direction, and mates with a driving gear 21*b* (FIG. 3) of the timing gear 21.

The clutch gear 4 is rotated synchronously with the lead screw 2, and the timing gear 21 is rotated in the arrow D direction (FIGS. 1 and 3) by the lead screw 2 rotating in the arrow C direction.

On the other hand, as the lead pin 7 passes through the lead-in groove 3*c* which is into the recovery groove 3*b* orthogonally disposed at a position where the clutch gear 4 and the timing gear 21 mate with each other, the rotation of lead screw 2 will not move the carrier 6.

If the timing gear 21 is rotated in the arrow D direction, the set lever 20 is rotated in the arrow E direction (FIG. 2), because the blade cam 21*a* of the timing gear 21 engages between small arm portions 20*a*, 20*b* of the set lever 20.

At this time, as the hook portion 16*c* of blade lever 16 (FIG. 2) engages a click portion of chassis 1, and the dowel 20*d* of set lever 20 fits into a long aperture 16*d* of blade lever 16 with a backlash, the rotational force is not immediately transmitted to the blade lever, whereby the set lever 20 only is rotated at an early time with the blade lever 16 stopped.

On the other hand, as the hook portion 21*c* of set lever 20 engages an engaging portion 18*a* of blade shaft 18 bearing on the blade lever 16, early rotation of the set lever 20 causes the blade shaft 18 to be lowered down in the arrow F direction, with the wiper (blade) 17 which is secured thereto being rotated in the G direction to be set at a wiping position.

With the set lever 20 being rotated by a predetermined amount, the engagement between the hook portion 16*c* and the click portion of chassis 1 is released, and the dowel 20*d* is brought into contact with an end portion of the long aperture 16*d*, whereby the set lever 20 and the blade lever 16 are integrally rotated.

Thus, with the timing gear 21 being further rotated in the D direction, the blade lever 16 as well as the set lever 20 is rotated in the arrow E direction, with the wiper 17 moving in the arrow X direction as shown in FIG. 4 to wipe and clean (wiping) a discharge port face 9*c* of recording head 9.

With a further rotation, the wiper 17 slides in contact with a wipe-over portion 23*a* of the ink absorbing member 23 carried by the ink absorbing member spring 22 at a predetermined position of chassis 1, whereby ink, water droplets, and contaminants adhering to the wiper 17 are imparted to the ink absorbing member 23.

Thus, foreign matter such as ink, water droplets and contaminants which are wiped away from the discharge port face 9*a* are imparted to the ink absorbing member 23, and the wiper 17 itself is again clean.

Further, as the ink carrier 19 also slides in contact with an absorbing face 23 of ink absorbing member 23, ink or other matter existent thereon which may drop from the wiper 17 and adhere to the ink carrier 19 are imparted to the ink absorbing member. 23 as well.

Ink or water droplets adhering to the ink absorbing member 23 are transferred from the ink absorbing member 23 through the ink transfer members 44*a*, 44*b* into the waste ink absorbing member 45 disposed in a desired space of chassis 1, due to the capillary action.

Therefore, even when a comparatively small volume of ink absorbing member 23 is used, a period during which it is saturated with ink or water content can be largely lengthened.

If the timing gear 21 is rotated in the arrow D direction, the engagement between the small arm portions 20*a*, 20*b* of set lever 20 and the blade cam 21*a* of timing gear 21 is disengaged, so that the small arm portions 20*a*, 20*b* can move along an external periphery of the blade cam 21*a*, and the rotation of timing gear 21 is not transmitted to the set lever 20.

Accordingly, the set lever 20 and the blade lever 16 are released from the timing gear.

Subsequently, with a further rotation of the timing gear 21, the cap 35 is stopped first at a position away from the recording head 9, because the cap cam A 21*c* restricts a rotation click 25*b* (FIG. 8) of cylinder cap 25 (FIGS. 8, 10 and 11).

Subsequently, with a further rotation of the timing gear 21 in the arrow D direction, as the cap cam A 21*c* leaves the rotation clock 25*b*, the cylinder 24 is rotated in the arrow G direction (FIG. 8) due to a biasing force of cap spring 43 tensioned between the chassis 1 and the rotation lever 24*f* of cylinder 24, through and the cap lever 32 driven with the rotation of the cylinder 24 moves toward the discharge port face 9*a*, thereby causing the cap 35 to enclose the discharge port face 9*a*.

Thus, the capping operation of recording head 9 can be completed.

The above operations are cleaning (wiping) and capping operations, and normally, the operation stops here to wait for a next record start signal.

If the next record start signal is issued, the reverse operations as above described are performed to enter the recording operation.

On the other hand, if a rotation operation signal is issued in a waiting state as above mentioned, the suction operation with the pump is entered.

Next, the pump operation will be explained.

First, with a rotation of timing gear 21, as the piston set cam 21*f* (FIG. 3) presses the piston presser roller 29 (FIGS. 8–11) mounted on the piston shaft 27, the piston shaft 27 moves in the arrow H direction.

With this movement of piston shaft 27, the piston 28 is also pressed to move in the arrow H direction, thereby causing the inside of pump chamber 42 to have a negative pressure.

In this case, the ink flow path 24*e* of cylinder 24 opens to the cylinder portion 24*a* until a rib 28*d* of the movable piston 28 on the piston shaft 27 moves to a position to close it. Ink flow path 24*e* connects with the ink flow path 24*h* through the groove 27*f*, so that the negative pressure within the pump chamber 42 only increases.

On the other hand, after the piston shaft 27 is further forced in so that the piston rib 28*d* in contact with the cylinder portion 24*a* passes the ink flow path 24*c*, the ink flow path 24*e* opens again, and the ink from the recording head 9 is sucked via a suction port 35*a*.

The ink sucked hereby passes through the ink flow path 32*f* within cap lever 32, through the communicating aperture 33*a* of lever seal 33 and the like flow path 24*e* of cylinder 24 into the pump chamber 42.

With a further rotation of timing gear 21, the rotation shaft 32*a* of cap lever 32 is moved backward slightly with the cap cam B 21*d* (FIG. 3), the cap 35 is separated away from the discharge port face 9*a* slightly, to eliminate residual ink by sucking the ink on the discharge port face 9*a* and within the suction cap 35 by the use of a residual negative pressure of pump chamber 42.

Next, if the timing gear 21 is rotated reversely (direction as indicated by an arrow I in FIG. 3), the piston reset cam 21*g* pulls the piston return roller 30 (FIG. 8) so as to move the piston shaft 27 in the arrow J direction.

At this time, the piston 28 moves after the piston carrier 27*c* on the piston shaft 27 makes contact therewith, a clearance Δ1 is generated between an end face 28*h* of piston 28 and the piston presser 27*b*.

With the movement of piston shaft 27 and piston 28 in the arrow J direction, waste ink sucked within the pump chamber 42 passes through the clearance Δ1, further passing through the groove 27*f* of piston shaft 27, ink flow path 24*c* of cylinder 24, and ink flow path within waste ink tube 24*g*, and exhausted into a near central portion of waste ink absorbing member 37 attached to the inside of feed roller 36.

An embodiment for resolving a phenomenon where waste ink flows backward after being sucked once, which is a technical problem associated with a conventional pump and ink absorbing system, will be described in the following.

Figure 13:
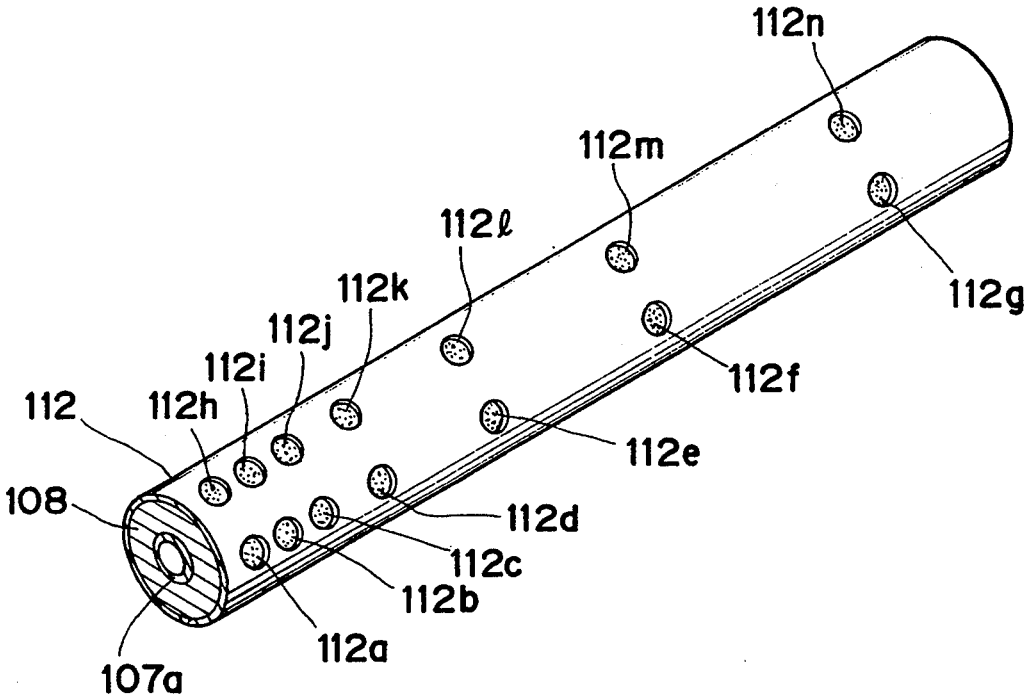
FIG. 13 is an example of a covering member according to an embodiment of the present invention.

Referring now to FIG. 13, a plurality of opening portions 112*a*–112*n* (a total of 14 in the present embodiment) is provided on a peripheral wall of coating member 112 within a conveying roller for conveying platen roller or a recording medium, wherein opening portions 112*a*–112*n*, which are circular and have the same opening areas, are arranged in two rows parallel to the axial direction of coating member 112, in such a manner that intervals between adjacent ones increase from a left side of waste ink absorbing member 108 as shown where waste ink absorption begins a right upward side as shown.

Next, another embodiment will be explained.

Figure 14:
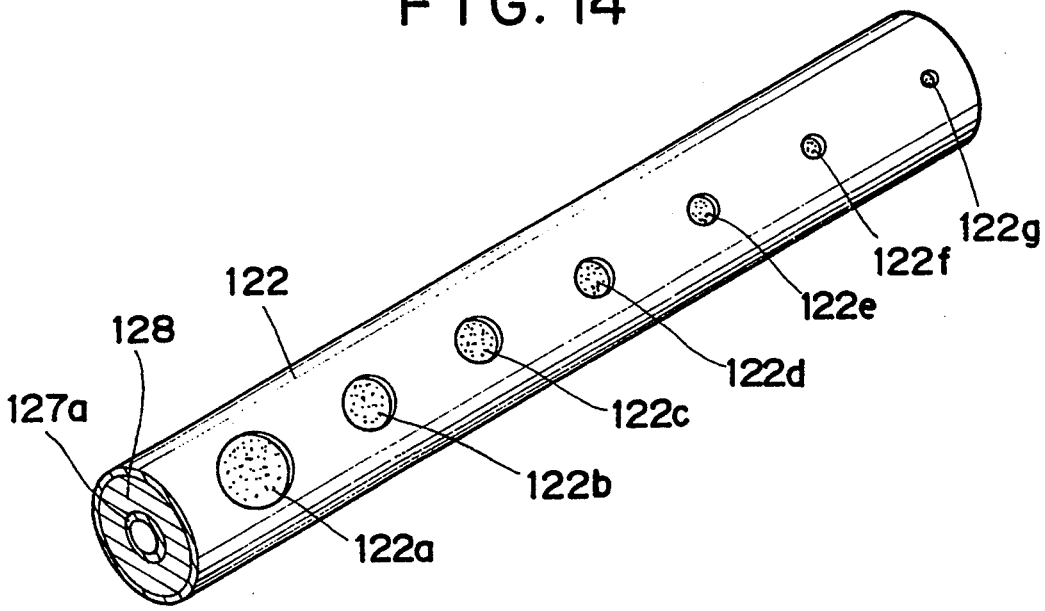
FIG. 14 is an example of a covering member according to another embodiment of the present invention.

In FIG. 14, around a peripheral wall of coating member 122, a plurality of circular opening portions 122*a*–122*g* (seven in the present embodiment) having different opening areas are arranged in a row parallel to the axial direction of the coating portion 122, wherein the opening areas of opening portions 122*a*–122*g* are smaller when going away from a side of waste ink absorbing member 128 where waste ink absorption is started.

Opening portions provided on the coating members as shown in two embodiments as above described are all circular apertures having an advantage of being easily fabricated.

The shape, number and positions of opening portions are not limited to those as shown in the embodiments as above described, but any opening portions communicating the waste ink absorbing member 128 to the atmosphere can be used.

Next, another embodiment will be described.

Figure 15:
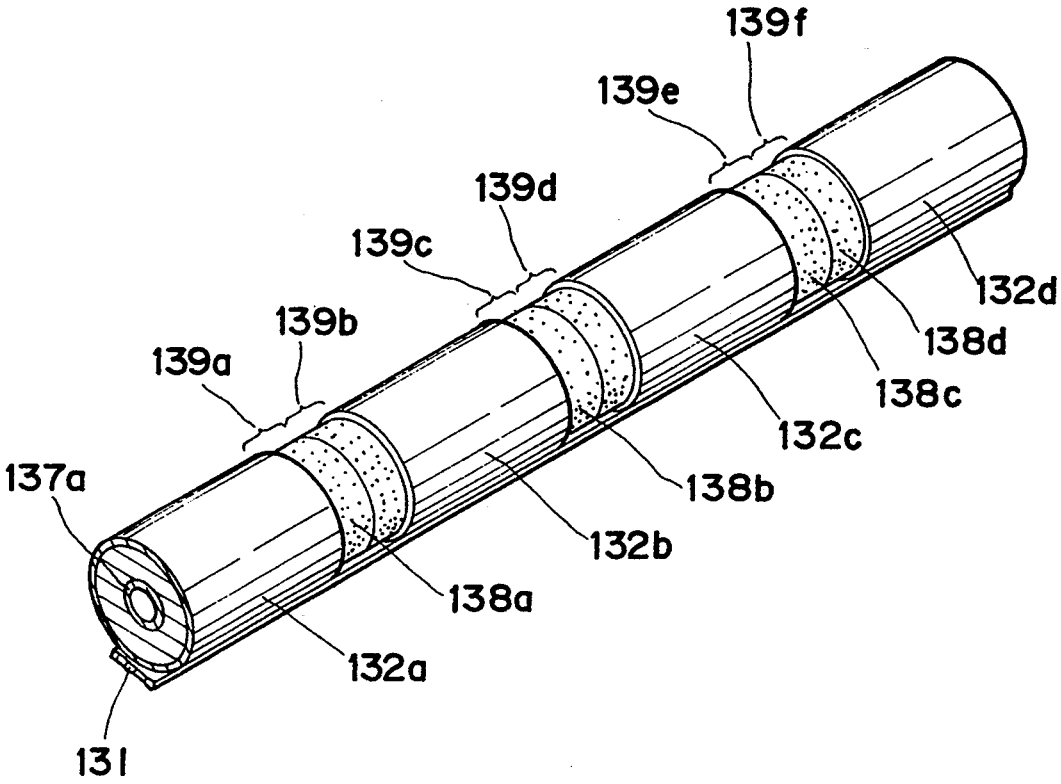
FIG. 15 is an example of a covering member according to another embodiment of the present invention.

In FIG. 15, a plurality of waste ink absorbing members 138*a*–138*d* (four in this embodiment), which are cylindrical and have the same outer diameter, are coated by cylindrical coating members 132*a*–132*d* having both ends opened while leaving circumferential strip-like exposed portions 139a–139f on both edges of the circumferential faces, respectively, for communicating waste ink absorbing member 128 to the atmosphere, with respective exposed end faces being made in contact and connected in the axial direction. However, an end face exposed on the right side of waste ink absorbing member 138d, located rightmost as shown, is aligned with an opening end of coating member 132d, while within the waste ink absorbing member 138a, located leftmost as shown, a waste ink tube 137a connected to the pump unit, not shown, has been inserted by an appropriate length.

The coating members 132a–132d are secured on a holding member 131 having both ends fixed onto a second side plate (not shown) provided on the pump unit and chassis, whereby the waste ink absorbing members 138a–138d are supported. However, the coating member 132d located at the right end portion as shown is fixed to the second side plate as well as the holding member 131, while the coating member 132a located at left end as shown is fixed to the pump unit.

While in the present embodiment, four waste ink absorbing members 138a–138d are connected, any appropriate number of connections can be used according to the size of an ink jet recording apparatus.

The coating members as shown in the aforementioned three embodiments are all fixed, but they can be constituted to be rotatable along with a roller for conveying a recording medium.

According to the described embodiments, the waste ink absorbing member 108 is communicated to the atmosphere at multiple places through a plurality of opening portions provided on peripheral wall of coating member 112, so that the flow of waste ink within the waste ink absorbing member 108 due to reciprocation of piston can be made smoother. Further, these opening portions have an effect of promoting the evaporation of waste ink absorbed into the waste ink absorbing member 108.

A further embodiment for resolving a phenomenon where waste ink flows backward will be described in the following.

Figure 16A:
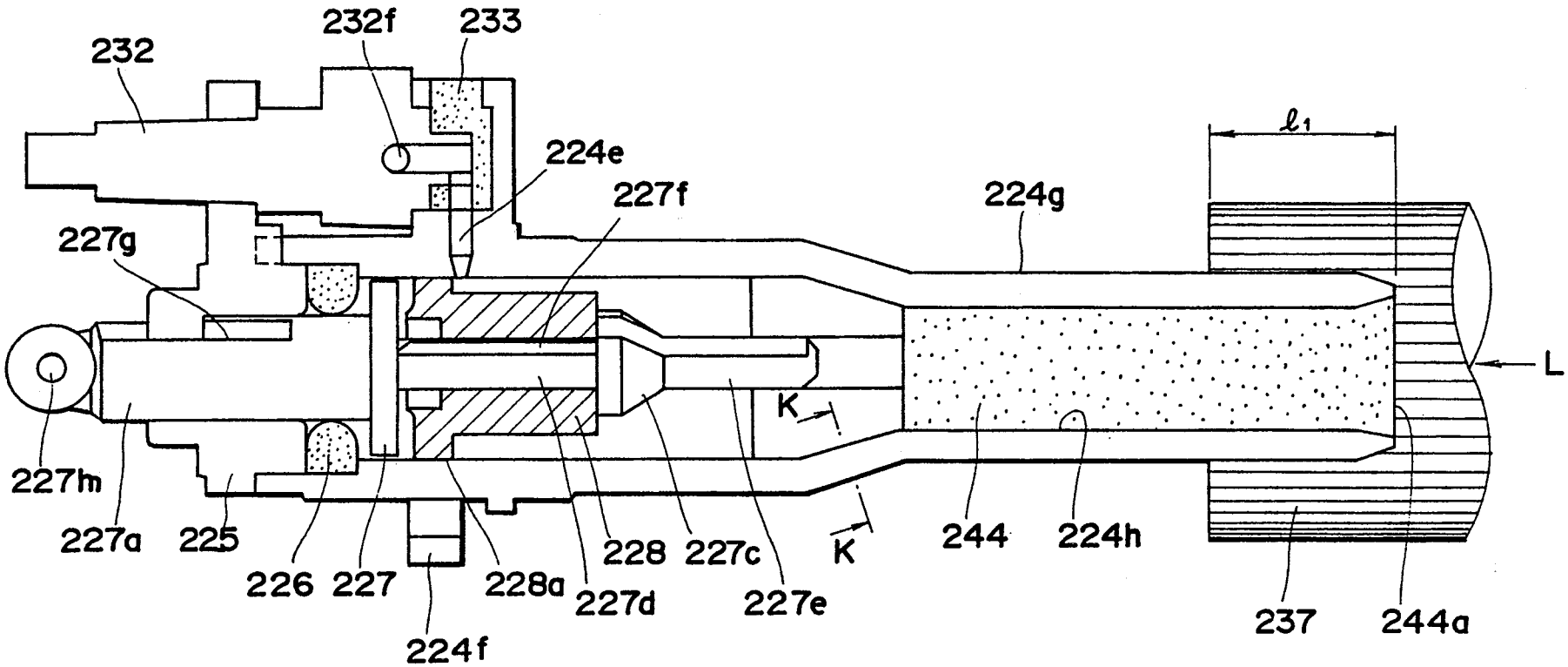
FIG. 16A is an example of a pump according to an embodiment of the present invention.

FIG. 16A is a cross-sectional view of a suction pump according to an embodiment of the present invention. In the figure, a waste ink tube 224g of cylinder 224 is inserted into the waste ink absorbing member 237 by its length $l_1$. The waste ink absorbing member 237 is an absorbing member of polyester fibers aligned horizontally, and inserting the waste ink tube 224g as previously described will not cause the absorbing member 237 to be entered into the ink flow path 224h. Accordingly, in the present embodiment, the ink is always absorbed into the absorbing member 244 within the cylinder and carried thereon by embedding the absorbing member 244 within the cylinder into the ink flow path 224h, without leaving the ink only within the ink flow path 224h. The ink carried on the absorbing member will migrate to the waste ink absorbing member 237, because an end face of the absorbing member 244 within the cylinder and the waste ink absorbing member 237 are closely in contact. Thereby, the absorbing member 244 within the cylinder is always placed in a state of absorbing ink without being saturated with ink.

In the present embodiment, the opening operation of cap 35 for the recording head 9 is carried out against the tension of a cap spring, not shown, and the closing operation is performed with the tension of cap spring. Then, as the pressure contact force of cap 35 against the discharge port face of recording head 9 is decreased by the amount of a sliding resistance due to the sliding between a surface of waste ink tube 224g and waste ink absorbing member 237, the waste ink tube 224g of cylinder 224 is of a stepped-shape to reduce the sliding resistance as much as possible.

Figure 16B:
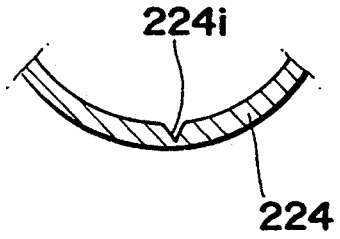
FIG. 16B is a cross-sectional view taken along a line K—K of FIG. 16A.

In the present embodiment, as the waste ink tube 224g of cylinder 224 is stepped as above described, the ink may remain on that portion. Thereby, to remove the ink, as shown in FIG. 16B, which is a cross-sectional view taken along a line K—K in FIG. 16A, a V-groove 224i is provided to move the ink staying in that step portion to the absorbing member 244 within cylinder, with the capillary action of ink in that groove 224i. Thereby, even if there is any step within the cylinder, the ink will not stay on the step portion.

Figure 16C:
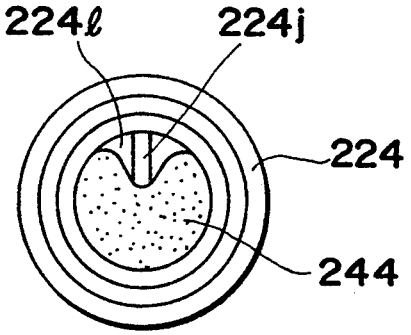
FIG. 16C is a view according to the direction of an arrow L of FIG. 16A.

Note that in the present embodiment, in order to be substantially in communication with the atmosphere during the capping, as shown in FIG. 16C which is a view according to the direction of the arrow L of FIG. 16A, a rib 224j is provided to form a clearance 224l within the ink flow path 244h even if the absorbing member 244 within cylinder is embedded. A material of absorbing member 244 within cylinder is inexpensive melamine foaming body, continuous foam.

Figure 17A:
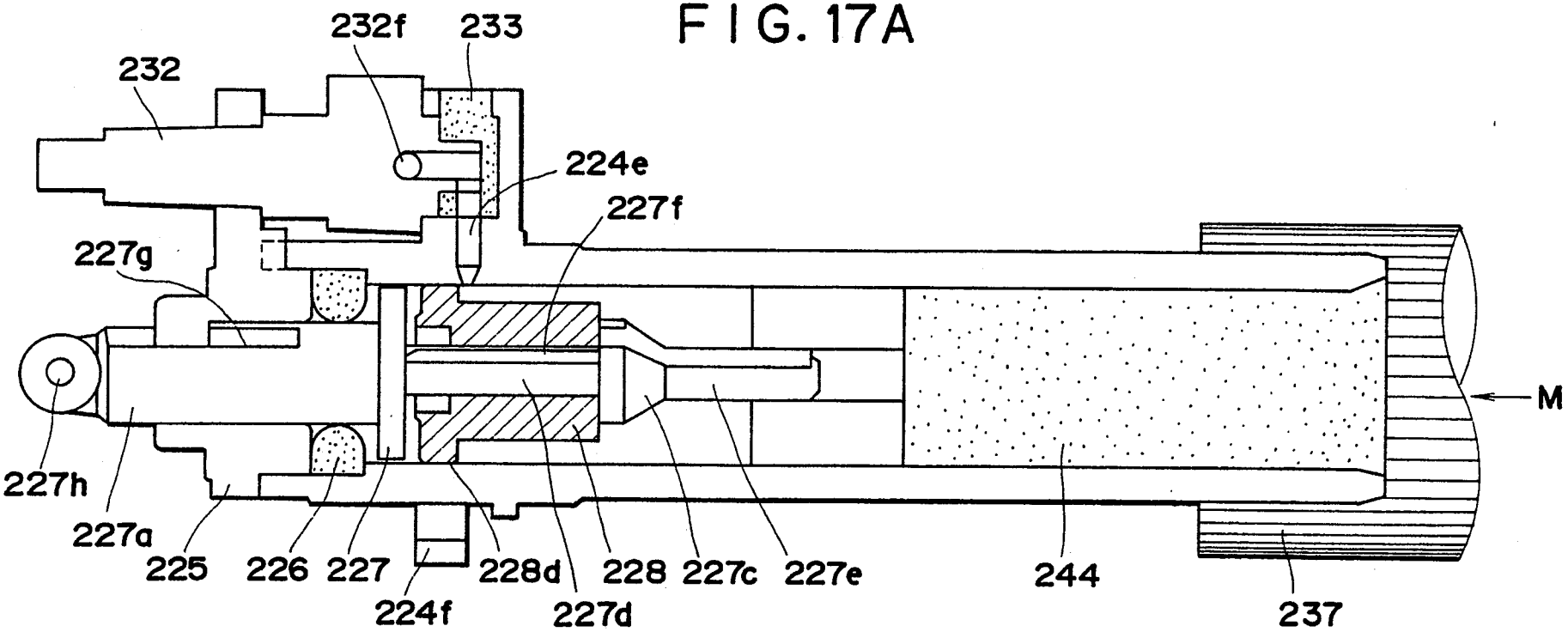
FIG. 17A is an example of a pump according to another embodiment of the present invention.
Figure 17B:
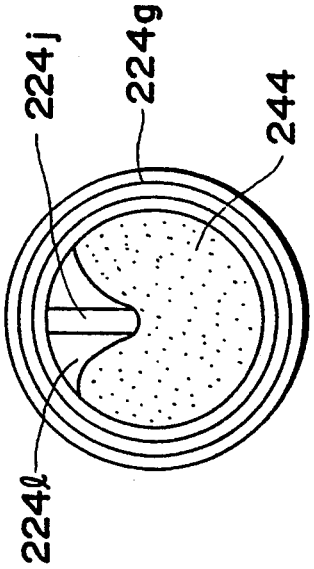
FIG. 17B is a view according to the direction of an arrow M of FIG. 14A.

FIG. 17A is a cross-sectional view of a suction pump according to another embodiment of the present invention. In this embodiment, a waste ink tube 224g of cylinder 224 is not stepped, but of a straight shape. In this case, as the waste ink tube 224g is not stepped, the ink will not stay within the cylinder 224. Also in this case, as shown in FIG. 17B, which is a view according to the direction of the arrow M of FIG. 17A, like previous embodiments, as a clearance 224l is provided by a rib 224j of waste ink tube 224g, the inside of pump is substantially in communication with the atmosphere even during the caping.

Figure 18:
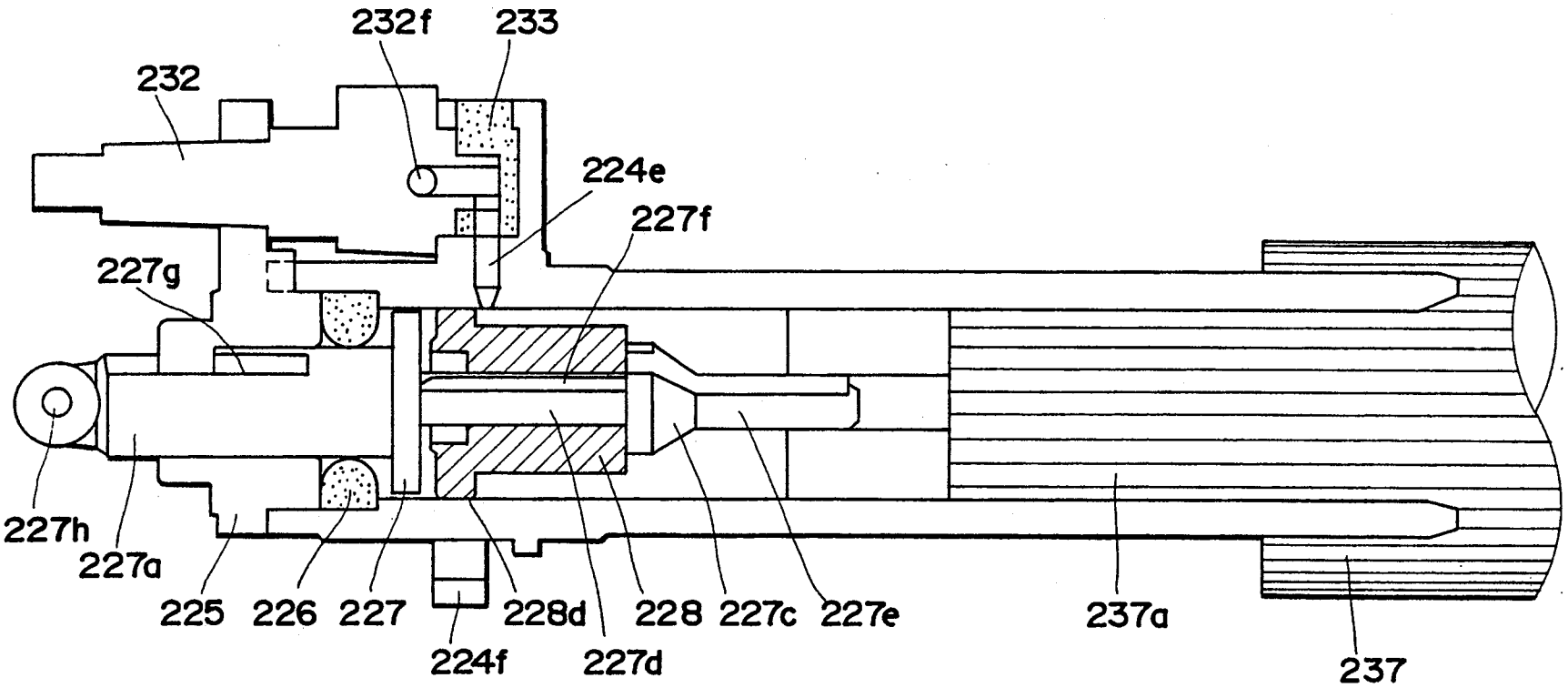
FIG. 18 is an example of a pump according to another embodiment of the present invention.

FIG. 18 is a cross-sectional view of a suction pump according to another embodiment of the present invention. As shown in the same figure, waste ink absorbing member 237 has a part 237a projected therefrom, and inserted into a cylinder flow path 224h, with the absorbing member 244 within cylinder and the waste ink absorbing member 237 being integrally formed.

According to the embodiments as above described, a conventional problem that the ink is liable to fix at a position of an end face 244a of absorbing member 244 within the cylinder, and waste ink is not absorbed smoothly into waste ink absorbing member 237 can be eliminated. That is, by providing an absorbing member within the cylinder, the above-mentioned phenomenon was resolved by making smoother the flow of waste ink passing from the absorbing member within the cylinder maintained in a constant humidity condition to the waste ink absorbing member, with the capillary action of ink. Thereby, as waste ink is absorbed smoothly into the waste ink absorbing member and evaporated, a problem of ink backflow as previously described can be resolved.

In the embodiments as above described, waste ink tubes 224g, 324g are both substantially in communication with the atmosphere. By communicating the waste ink tubes to the cap 35 even during the capping of recording head, the inside of the cap could be substantially in communication with the atmosphere during the capping. With this constitution, an embodiment of the mechanism for preventing the meniscus from being depressed at the capping will be described in the following.

Figure 19:
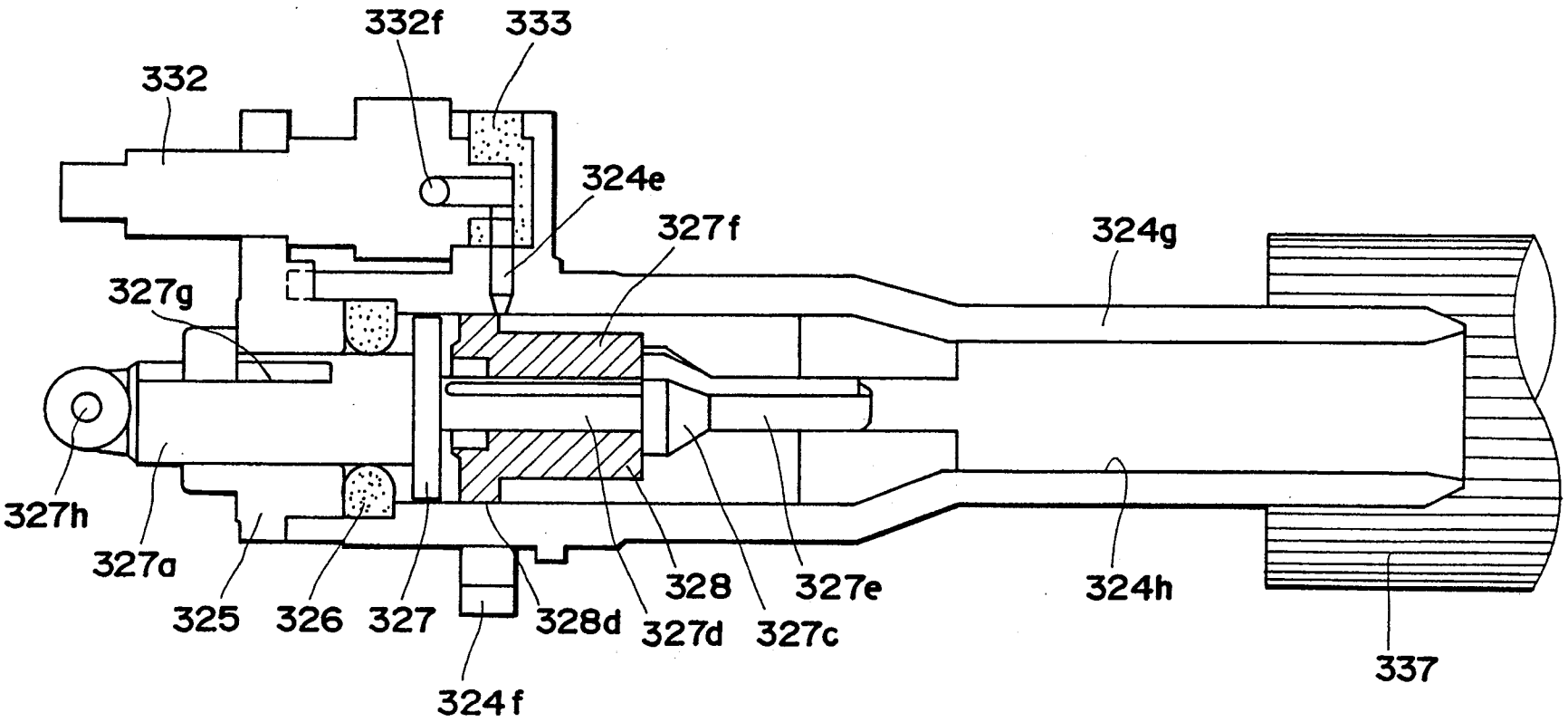
FIG. 19 is an example of a pump according to another embodiment of the present invention.

FIG. 19 shows a state during the capping where a piston 328 reaches an upper dead center in the embodiment of the present invention. A rib portion 328*d* of piston 328 totally opens without closing an ink flow path 324*e* of cylinder 324. The placement of the piston rib portion 328*d* at this position is made possible by changing a cam lift diagram for a piston set cam 321*f* of timing gear 321 or piston reset cam 321*g*. When a waste ink tube 324*g* of cylinder 324 opens totally to the atmosphere, the inside of the cap is not pressed at all even if cap 325 may deform. But in this state, the feature of preventing non-discharge ink due to fixing of ink in a nozzle 9*c* of recording head 9 is not achieved at all. Accordingly, in this embodiment, since an end portion of waste ink tube 324*g* within cylinder 324 has been inserted into a waste ink absorbing member 337 with certain gas permeability, the inside of cap 35 during the capping is substantially in communication with the atmosphere, and is not pressed even if the cap may deform, whereby the ink meniscus in the recording head 9 will not flow back into a tank portion 9*b* to break the meniscus and make the recording impossible. As waste ink has been absorbed into the waste ink absorbing member 337, the inside of cap is wetted adequately with ink, so that the nozzle 9*c* of recording head 9 may not have ink fixed therein.

Figure 20:
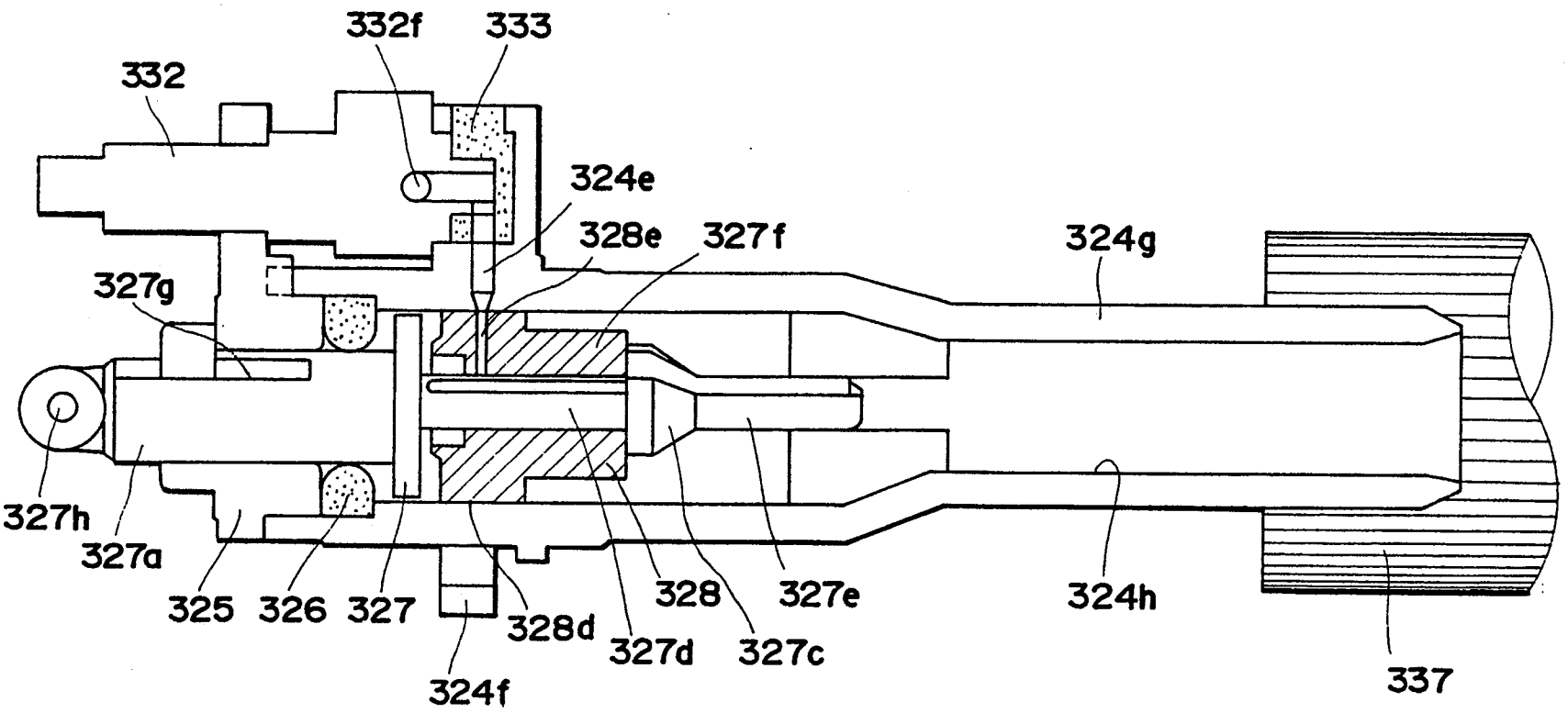
FIG. 20 is an example of a pump according to another embodiment of the present invention.

FIG. 20 shows another embodiment of the present invention, in which an object of the present invention can be accomplished by using a conventional timing gear 21 and with the exact same software control. That is a constitution in which a hole 328*l* provided in a rib 328*b* of piston 328 is made in communication with the inside of cylinder 324. With this constitution, it is substantially in communication with the atmosphere through a hole 328*e* of piston 328 during the capping.

According to the example of an ink jet recording apparatus as above described, waste ink absorbing member 45 is appropriately disposed by using a clearance within the ink jet recording apparatus, and an ink absorbing member 23 for absorbing the ink wiped over by wiper 17 for cleaning a discharge port face 9*a* of recording head 9 and the waste ink absorbing member 45 are connected by means of ink transfer members 44*a*, 44*b*, so that the ink can be delivered into the waste ink absorbing member using the capillary action of ink within the ink transfer members 44*a*, 44*b*, whereby a period of being saturated with ink in the ink absorbing member 23 can be greatly increased without increasing a volume of the ink absorbing member 23, and thus, the ink absorbent capability can be significantly improved.

Further, as waste ink can be evaporated from a surface of such continuous absorbing members, a waste ink backflow problem can be resolved by decreasing the amount of suction for a suction pump itself to increase the evaporation efficiency of waste ink absorbed by the pump.

As the waste ink absorbing member 45 as above described is fixedly disposed using adhesive or the like in a space within recording apparatus, it can be disposed freely in accordance with the space, for example, by making the sheet-like shape, without any limitation of volume or number thereof, whereby an ink jet recording apparatus in which the waste ink absorbent ability is very high and thereby the number of sheets to be recorded is greatly increased can be obtained with a simple structure and without losing the compactness of recording apparatus.

Note that the ink transfer members 44*a*, 44*b* are used to transfer the ink, and sufficiently effective even with a small cross section (e.g., a thickness of 1 mm), and the bridging function of ink can be fully exhibited even at a narrow place.

Figure 12:
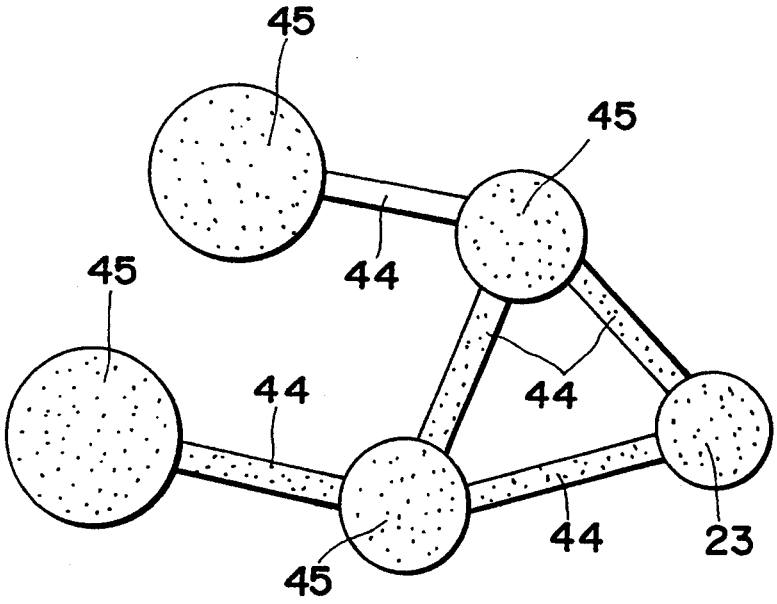
FIG. 12 is a typical view for illustrating a configuration of a waste ink absorbing system where a plurality of waste ink absorbing members are used.

FIG. 12 is a typical view showing an arrangement example where a plurality of waste ink absorbing members 45 (four in the example as shown) are connected by ink transfer members 44, for a single ink absorbing member 23.

In this way, with the provision of a plurality of waste ink absorbing members 45, the ink absorbent ability of an ink absorbing member 23 can be further easily improved by the effective use of an internal space within recording apparatus.

Note that the example as previously described shows a case where a cartridge-type recording head 9 integral with an ink tank 9*b* is used as a recording head, whereas the present invention is not limited to this one, but is also applicable to a case of using a recording head of the type without almost requiring the exchange, and can provide the same effect.

In the example as above mentioned, the present invention is explained by illustrating an ink jet recording apparatus of the serial-scan type having a recording head 9 mounted on carrier 6, whereas the present invention is also applicable to an ink jet recording apparatus with the other recording method, such as a line-type ink jet recording apparatus using a line-type recording head which covers a recording area in the paper-width direction of recording medium, and the same operation effect can be achieved.

The present invention is also effective irrespective of the number of recording heads.

The present invention brings about excellent effects particularly in an ink jet recording apparatus having an ink jet recording head of the ink jet system for recording by forming fine liquid droplets with heat energy among the various ink jet recording systems.

As to its representative constitution and principle, for example, one practiced by use of the basic principle disclosed in, for example, U.S. Pat. Nos. 4,723,129 and 4,740,796 is preferred. This system is applicable to either of the so-called on-demand type and the continuous type. Particularly, the case of the on-demand type is effective because, by applying at least one driving signal, which gives rapid temperature elevation exceeding a nucleus boiling point corresponding to the recording information on electricity-heat converters arranged corresponding to the sheets or liquid channels holding a liquid (ink), heat energy is generated at the electricity-heat converters to effect film boiling at the heat acting surface of the recording head, and consequently the bubbles within the liquid (ink) can be formed corresponding one by one to the driving signals. By discharging the liquid (ink) though an opening for discharging by growth and shrinkage of the bubble, at least one droplet is formed. By making the driving signals into pulse shapes, growth and shrinkage of the bubble can be effected instantly and adequately to accomplish more preferable discharging of the liquid (ink) which is particularly excellent in response characteristic.

As the driving signals of such pulse shape, those as disclosed in U.S. Pat. Nos. 4,463,359 and 4,345,262 are suitable. Further excellent recording can be performed by employment of the conditions described in U.S. Pat.

No. 4,313,124 of the invention concerning the temperature elevation rate of the above-mentioned heat acting surface.

As the constitution of the recording head, in addition to the combination of the discharging orifice, liquid channel, and electricity-heat converter (linear liquid channel or right-angled liquid channel) as disclosed in the above-mentioned respective specifications, the constitution by use of U.S. Pat. No. 4,558,333, or 4,459,600 disclosing the constitution having the heat acting portion arranged in the flexed region is also included in the present invention.

In addition, the present invention can be also effectively made having the constitution as disclosed in Japanese Laid-Open patent Application No. 59-123670 which discloses a constitution using a slit common to a plurality of electricity-heat converters as the discharging portion of the electricity-heat converter or Japanese Laid-Open Patent Application No. 59-138461 which discloses a constitution having the opening for absorbing pressure wave of heat energy correspondent to the discharging portion.

Further, as the recording head of the full line type having a length corresponding to the maximum width of a recording medium which can be recorded by the recording device, either the constitution which satisfies its length by a combination of a plurality of recording heads as disclosed in the above-mentioned specifications or the constitution as one recording head integrally formed may be used, and the present invention can exhibit the effects as described above further effectively.

In addition, the present invention is effective for a recording head of the freely exchangeable chip type which enables electrical connection to the main device or supply of ink from the main device by being mounted on the main device, or a recording head of the cartridge type having an ink tank integrally provided on the recording head itself.

Also, addition of a restoration means for the recording head, a preliminary auxiliary means, etc. provided as the constitution of the recording device of the present invention is preferable, because the effect of the present invention can be further stabilized. Specific examples of these may include, electricity-heat converters or another type of heating elements, or preliminary heating means according to a combination of these, and it is also effective for performing stable recording to perform preliminary mode which performs discharging separate from recording.

Further, as the recording mode of the recording device, the present invention is extremely effective for not only the recording mode only of a primary color such as black etc., but also a device equipped with at least one of plural different colors or full color by color mixing, whether the recording head may be either integrally constituted or combined in plural number.

Further, a recording apparatus according to the present invention is provided integrally or separately as an image output terminal for an information processing equipment such as a word processor or computer, a copying machine in combination with a reader, or a facsimile terminal equipment having the transmission and reception feature.

According to the present invention, with a feature of preventing the ink within a pump from a suction portion of the pump to the outside of the pump, an ink jet recording apparatus and a pump mechanism for use therewith which can prevent the ink from flowing backward to the sucked member can be obtained.

According to the present invention, an ink jet recording apparatus and a pump mechanism for use therewith in which an ink meniscus is not depressed can be obtained.

What is claimed is:

1. A pump mechanism for an ink jet recording apparatus using an ink jet recording head having a discharge port, said mechanism comprising:

a pump having a suction portion for sectioning matter from an enclosing member for enclosing the discharge port of the recording head, said pump switching between suction and non-suction operation of the suction portion by a reciprocating motion of a piston along a reciprocation path within a cylinder, wherein the cylinder is free from having a valve;

a holding member connected to said pump for holding waste ink from said pump, said holding member opening to the atmosphere; and a prevention mechanism provided in said pump for preventing a backflow of ink within said pump from the suction portion of said pump to outside of said pump due to the reciprocating motion of the piston, said prevention mechanism comprising a waste ink absorbing member disposed between the reciprocation path of said piston in said pump and said holding member.

2. A pump mechanism of an ink jet recording apparatus according to claim 1, wherein:

said enclosing member comprises a cap for enclosing the discharge port of the ink jet recording head, and said prevention mechanism forms part of an ink communicating path so that an inside of the cap is substantially in communication with the atmosphere through a path passing through an inside of said pump.

3. A pump mechanism of an ink jet recording apparatus according to claim 2, wherein:

said holding member comprises a waste ink absorbing member and a waste ink exhaust port of said pump is embedded and carried in the waste ink absorbing member of said holding member.

4. A pump mechanism of an ink jet recording apparatus according to claim 1, wherein:

said holding member comprises a waste ink absorbing member and a waste ink exhaust port of said pump is embedded and carried in the waste ink absorbing member of said holding member.

5. An ink jet recording apparatus using an ink jet recording head having a discharge port for discharging ink to record on a recording medium, said apparatus comprising:

a cleaning member for cleaning a discharge port face of the recording head;

waste ink absorbing members for absorbing ink adhering to said cleaning member, said absorbing members comprising a plurality of consecutive absorbing members;

a pump having a suction portion for suctioning matter from an enclosing member for enclosing the discharge port of the recording head, said pump switching between suction and non-suction operation of the suction portion by a reciprocating motion of a piston along a reciprocation path within a cylinder, wherein said cylinder is free from having a valve;

a holding member connected to said pump for holding waste ink from said pump, said holding member opening to the atmosphere; and a prevention mechanism provided in said pump for preventing a backflow of ink within said pump from the suction portion of said pump to outside of said pump due to the reciprocating motion of the piston, said prevention mechanism comprising a waste ink absorbing member disposed between the reciprocation path of said piston in said pump and said holding member.

6. An ink jet recording apparatus according to claim 5, wherein said enclosing member comprises a cap for enclosing the discharge port of the ink jet recording head, and said prevention mechanism forms a portion of an ink communicating path so that an inside of said cap is substantially in communication with the atmosphere through a path passing through an inside of said pump.

7. An ink jet recording apparatus according to claim 6, wherein said holding member comprises a waste ink absorbing member, and a waste ink exhaust port of said pump is embedded and carried in the waste ink absorbing member of said holding member.

8. An ink jet recording apparatus according to claim 5, wherein said holding member comprises a waste ink absorbing member and a waste ink exhaust port of said pump is embedded and carried in the waste ink absorbing member of said holding member.

9. An ink jet recording apparatus according to claim 5, wherein an absorbing member farthest from said cleaning member has a larger surface area than an absorbing member nearest to said cleaning member.

10. An ink jet recording apparatus according to claim 5, wherein said recording apparatus comprises a conveying roller for conveying the recording medium to a recording area, and further comprises a waste ink absorbing member for communicating to the atmosphere through a plurality of opening portions inside said conveying roller.

11. An ink jet recording apparatus according to claim 5, wherein said recording head is an ink jet recording head for discharging the ink from an ink discharge port to record an image.

12. An ink jet recording apparatus according to claim 5, wherein said recording head contains the ink for recording an image.

13. An ink jet recording apparatus according to claim 5, wherein the ink jet recording head has an electrothermal converting element for generating energy used for discharging the ink.

14. An ink jet recording apparatus according to claim 13, wherein the ink jet recording head discharges the ink by causing film boiling utilizing energy generated by the electrothermal converting element.

15. An ink jet recording apparatus according to claim 5, wherein the ink jet recording head is carried on a carriage moving in a predetermined direction.

16. An ink jet recording apparatus according to claim 5, further comprising a conveying mechanism for conveying the recording medium.

17. An ink jet recording apparatus using an ink jet recording head for discharging ink through a discharge port to record on a recording medium, said apparatus comprising:

a pump having a suction portion for suctioning matter from an enclosing member for enclosing the discharge port of the recording head, said pump switching between suction and non-suction operation of the suction portion by a reciprocating motion of a piston along a reciprocation path within a cylinder, wherein the cylinder is free from having a valve;

a holding member connected to said pump for holding waste ink from said pump, said holding member being disposed within a conveying roller and opening to the atmosphere through a plurality of opening positions; and a prevention mechanism provided in said pump for preventing a backflow of ink within said pump from the suction portion of said pump to outside of said pump due to the reciprocating motion of the piston, said prevention mechanism comprising a waste ink absorbing member disposed between the reciprocation path of said piston in said pump and said holding member.

18. An ink jet recording apparatus according to claim 17, wherein:

said enclosing member comprises a cap for enclosing the discharge port of the ink jet recording head, and said prevention mechanism forms a portion of an ink communicating path so that an inside of said cap is substantially in communication with the atmosphere through a path passing through an inside of said pump.

19. An ink jet recording apparatus according to claim 18, wherein:

said holding member comprises a waste ink absorbing member and a waste ink exhaust port of said pump is embedded and carried in the waste ink absorbing member of said holding member.

20. An ink jet recording apparatus according to claim 17, wherein:

said holding member comprises a waste ink absorbing member and a waste ink exhaust port of said pump is embedded and carried in the waste ink absorbing member of said holding member.

21. An ink jet recording apparatus according to claim 17, further comprising a cleaning member for cleaning the discharge port of the recording head and cleaning-member waste ink absorbing members for absorbing ink adhering to said cleaning member, said absorbing members comprising a plurality of consecutive absorbing members, wherein an absorbing member farthest from the cleaning member has a larger surface area than an absorbing member nearest to the cleaning member.

22. An ink jet recording apparatus according to claim 17, wherein said recording head is an ink jet recording head for discharging the ink from an ink discharge port to record an image.

23. An ink jet recording apparatus according to claim 17, wherein said recording head contains the ink for recording an image.

24. An ink jet recording apparatus according to claim 17, wherein the ink jet recording head has an electrothermal converting element for generating energy used for discharging the ink.

25. An ink jet recording apparatus according to claim 24, wherein the ink jet recording head discharges the ink by causing film boiling utilizing energy generated by the electrothermal converting element.

26. An ink jet recording apparatus according to claim 24, wherein:

said holding member comprises a waste ink absorbing member, and a waste ink exhaust port of said pump is embedded and carried in the waste ink absorbing member of said holding member.

27. An ink jet recording apparatus according to claim 24, further comprising a cleaning member for cleaning said discharge port of said recording head; waste ink absorbing members for absorbing ink adhering to said cleaning member, said absorbing members comprising a plurality of consecutive absorbing members.

28. An ink jet recording apparatus according to claim 27, wherein:

an absorbing member farthest from said cleaning member has a larger surface area than an absorbing member nearest to said cleaning member.

29. An ink jet recording apparatus according to claim 24, wherein, said enclosing member comprises a cap and said pump comprises a piston which can communicate said pump constitution to an inside of the cap while the cap encloses a face of the discharge port.

30. An ink jet recording apparatus according to claim 17, wherein the ink jet recording head is carried on a carriage moving in a predetermined direction.

31. An ink jet recording apparatus according to claim 17, further comprising a conveying mechanism for conveying the recording medium.

32. An ink jet recording apparatus using an ink jet recording head for discharging ink through a discharge port to record on a recording medium, said apparatus comprising:

a pump having a suction portion for suctioning matter from an enclosing member for enclosing the discharge port of the recording head, said pump switching between suction and non-suction operation of the suction portion by a reciprocating motion of a piston along a reciprocation path within a cylinder, wherein the cylinder is free from having a valve;

a holding member connected to said pump for holding waste ink from said pump, said holding member opening to the atmosphere; and a prevention mechanism provided in said pump for preventing a backflow of ink within said pump from the suction portion of said pump to outside of said pump due to the reciprocating motion of the piston, wherein said prevention mechanism comprises a waste ink absorbing member disposed between the reciprocation path and said holding member and said enclosing member comprises a cap for enclosing the discharge port of the ink jet recording head, and wherein said prevention mechanism forms a portion of an ink communicating path so that an inside of the cap is substantially in communication with the atmosphere through a path passing through an inside of said pump.

33. An ink jet recording apparatus according to claim 32, wherein said recording head is an ink jet recording head for discharging the ink from an ink discharge port to record an image.

34. An ink jet recording apparatus according to claim 32, wherein said recording head contains the ink for recording an image.

35. An ink jet recording apparatus according to claim 32, wherein the ink jet recording head has an electrothermal converting element for generating energy used for discharging the ink.

36. An ink jet recording apparatus according to claim 32, wherein the ink jet recording head discharges the ink by causing film boiling utilizing energy generated by the electrothermal converting element.

37. An ink jet recording apparatus according to claim 32, wherein the ink jet recording head is carried on a carriage moving in a predetermined direction.

38. An ink jet recording apparatus according to claim 32, further comprising a conveying mechanism for conveying the recording medium.

39. A pump mechanism for an ink jet recording apparatus using an ink jet recording head having a discharge port, said mechanism comprising:

a pump having a suction mechanism for suctioning matter from an enclosing member for enclosing the discharge port of the recording head, said pump having no valve associated with said suction mechanism to perform suctioning;

a holding member connected to said pump for holding waste ink from said pump, said holding member opening to the atmosphere; and a prevention mechanism provided in said pump for preventing a backflow of ink within said pump from the suction mechanism of said pump to outside of said pump due to a suction operation by said suction mechanism, said prevention mechanism comprising a waste ink absorbing member disposed between an area at which said suction mechanism performs the suction operation and said holding member.

40. A pump mechanism of an ink jet recording apparatus according to claim 39, wherein said enclosing member comprises a cap for enclosing the discharge port of the ink jet recording head, and said prevention mechanism forms a portion of an ink communicating path so that an inside of the cap is substantially in communication with the atmosphere through a path passing through an inside of said pump.

41. A pump mechanism of an ink jet recording apparatus according to claim 40, wherein said holding member comprises a waste ink absorbing member and a waste ink exhaust port of said pump is embedded and carried in said waste ink absorbing member of said holding member.

42. A pump mechanism of an ink jet recording apparatus according to claim 39, wherein said holding member comprises a waste ink absorbing member and a waste ink exhaust port of said pump is embedded and carried in said waste ink absorbing member of said holding member.

43. An ink jet recording apparatus using an ink jet recording head having a discharge port for discharging ink to record on a recording medium, said apparatus comprising:

a cleaning member for cleaning a discharge port face of the recording head;

waste ink absorbing members for absorbing ink adhering to said cleaning member, said absorbing members comprising a plurality of consecutive absorbing members;

a pump having a suction mechanism for suctioning matter from an enclosing member for enclosing the discharge port of the recording head, said pump having no valve associated with said suction mechanism to perform suctioning;

a holding member connected to said pump for holding waste ink from said pump, said holding member opening to the atmosphere; and a prevention mechanism provided in said pump for preventing a backflow of ink within said pump from the suction portion of said pump to outside of said pump due to a suction operation by said suction mechanism, said prevention mechanism comprising a waste ink absorbing member disposed between an area at which said suction mechanism performs the suction operation and said holding member.

44. An ink jet recording apparatus according to claim 43, wherein said enclosing member comprises a cap for enclosing the discharge port of the ink jet recording head, and said prevention mechanism forms a portion of an ink communicating path so that an inside of said cap is substantially in communication with the atmosphere through a path passing through an inside of said pump.

45. An ink jet recording apparatus according to claim 44, wherein said holding member comprises a waste ink absorbing member and a waste ink exhaust port of said pump is embedded and carried in the waste ink absorbing member of said holding member.

46. An ink jet recording apparatus according to claim 43, wherein said holding member comprises a waste ink absorbing member and a waste ink exhaust port of said pump is embedded and carried in the waste ink absorbing member of said holding member.

47. An ink jet recording apparatus according to claim 43, wherein an absorbing member farthest from said cleaning member has a larger surface area than an absorbing member nearest to said cleaning member.

48. An ink jet recording apparatus according to claim 43, wherein said recording apparatus comprises a conveying roller for conveying the recording medium to a recording area, and further comprises a waste ink absorbing member for communicating to the atmosphere through a plurality of opening portions inside the conveying roller.

49. An ink jet recording apparatus according to claim 43, wherein the recording head is an ink jet recording head for discharging the ink from an ink discharge port to record an image.

50. An ink jet recording apparatus according to claim 43, wherein the recording head contains the ink for recording an image.

51. An ink jet recording apparatus according to claim 43, wherein the ink jet recording head comprises an electrothermal converting element for generating energy used for discharging the ink.

52. An ink jet recording apparatus according to claim 51, wherein the ink jet recording head discharges the ink by causing film boiling utilizing energy generated by said electrothermal converting element.

53. An ink jet recording apparatus according to claim 43, wherein the ink jet recording head is carried on a carriage moving in a predetermined direction.

54. An ink jet recording apparatus according to claim 43, further comprising a conveying mechanism for conveying the recording medium.

55. An ink jet recording apparatus using an ink jet recording head having a discharge port for discharging ink to record on a recording member, said apparatus comprising:

a pump having a suction mechanism for suctioning matter from an enclosing member for enclosing the discharge port of the recording head, said pump having no valve associated with said suction mechanism to perform suctioning;

a holding member connected to said pump for holding waste ink from said pump, said holding member being disposed within a conveying roller and opening to the atmosphere through a plurality of opening portions; and a prevention mechanism provided in said pump for preventing a backflow of ink within said pump from the suction mechanism of said pump to outside of said pump due to a suction operation of said suction mechanism, said prevention mechanism comprising a waste ink absorbing member disposed between an area at which said suction mechanism performs the suction operation and said holding member.

56. An ink jet recording apparatus according to claim 55, wherein said enclosing member comprises a cap for enclosing the discharge port of the ink jet recording head, and said prevention mechanism forms a portion of an ink communicating path so that an inside of said cap is substantially in communication with the atmosphere through a path passing through an inside of said pump.

57. An ink jet recording apparatus according to claim 56, wherein said holding member comprises a waste ink absorbing member, and a waste ink exhaust port of said pump is embedded and carried in the waste ink absorbing member of said holding member.

58. An ink jet recording apparatus according to claim 55, wherein said holding member comprises a waste ink absorbing member and a waste ink exhaust port of said pump is embedded and carried in the waste ink absorbing member of said holding member.

59. An ink jet recording apparatus according to claim 55, further comprising a cleaning member for cleaning the discharge port of the recording head and cleaning-member waste ink absorbing members for absorbing ink adhering to said cleaning member, said absorbing members comprising a plurality of consecutive absorbing members, wherein an absorbing member farthest from the cleaning member has an area greater than an absorbing member nearest the cleaning member.

60. An ink jet recording apparatus according to claim 55, wherein the recording head is an ink jet recording head for discharging the ink from an ink discharge port to record an image.

61. An ink jet recording apparatus according to claim 55, wherein the ink jet recording head has an electrothermal converting element for generating energy used for discharging the ink.

62. An ink jet recording apparatus according to claim 61, wherein the ink jet recording head discharges the ink by causing film boiling utilizing energy generated by the electrothermal converting element.

63. An ink jet recording apparatus according to claim 61, wherein said holding member comprises a waste ink absorbing member, and a waste ink exhaust port of said pump is embedded and carried in the waste ink absorbing member of said holding member.

64. An ink jet recording apparatus according to claim 61, further comprising a cleaning member for cleaning a discharge port face of said recording head and cleaning-member waste ink absorbing members for absorbing ink adhering to said cleaning member, said absorbing members comprising a plurality of consecutive absorbing members.

65. An ink jet recording apparatus according to claim 64, wherein an absorbing member farthest from said cleaning member has a larger surface area than an absorbing member nearest to said cleaning member.

66. An ink jet recording apparatus according to claim 61, wherein said enclosing member comprises a cap and said pump comprises a piston which can communicate said pump constitution to an inside of said cap while said cap encloses the discharge port face.

67. An ink jet recording apparatus according to claim 64, wherein the ink jet recording head is carried on a carriage moving in a predetermined direction.

68. An ink jet recording apparatus according to claim 55, further comprising a conveying mechanism for conveying the recording medium.

69. An ink jet recording apparatus according to claim 55, wherein the recording head contains the ink for recording an image.

70. An ink jet recording apparatus using an ink jet recording head having a discharge port for discharging ink to record on a recording member, said apparatus comprising:

a pump having a suction mechanism for suctioning matter from an enclosing member for enclosing the discharge port of the recording head, said pump having no valve associated with said suctioning mechanism to perform suctioning;

a holding member connected to said pump for holding waste ink from said pump, said holding member opening to the atmosphere; and a prevention mechanism provided in said pump for preventing a backflow of ink within said pump from the suction mechanism of said pump to outside of said pump due to a suction operation by said suction mechanism, wherein said prevention mechanism comprises a waste ink absorbing member disposed between an area at which said suction mechanism performs the suction operation and said holding member, and said enclosing member comprises a cap for enclosing the discharge port of the ink jet recording head, and wherein said prevention mechanism forms a portion of an ink communicating path so that an inside of said cap is substantially in communication with the atmosphere through a path passing through an inside of said pump.

71. An ink jet recording apparatus according to claim 70, wherein the recording head contains the ink for recording an image.

72. An ink jet recording apparatus according to claim 70, wherein the recording head is an ink jet recording head for discharging the ink from an ink discharge port to record an image.

73. An ink jet recording apparatus according to claim 70, wherein the ink jet recording head has an electrothermal converting element for gathering energy used for discharging the ink.

74. An ink jet recording apparatus according to claim 73, wherein the ink jet recording head discharges the ink by causing film boiling utilizing energy generated by the electrothermal converting element.

75. An ink jet recording apparatus according to claim 70, wherein the ink jet recording head is carried on a carriage moving in a predetermined direction.

76. An ink jet recording apparatus according to claim 70, further comprising a conveying mechanism for conveying the recording medium.

* * * * *

UNITED STATES PATENT AND TRADEMARK OFFICE

CERTIFICATE OF CORRECTION

PATENT NO. : 5,357,275

DATED : October 18, 1994

INVENTOR(S) : MASAHARU IKADO, ET AL.

It is certified that error appears in the above-identified patent and that said Letters Patent is hereby corrected as shown below:

ON TITLE PAGE

In [57] ABSTRACT:
Line 8, "pump" should read --pump,--.
Line 11, "pump," should read --pump--.
Line 12, "piston" should read --piston,--.

COLUMN 1

Line 56, "(but" should read --but--.
Line 57, "apparatus)." should read --apparatus.--.

COLUMN 3

Line 31, "FIG. 14A." should read --FIG. 17A.--.

COLUMN 4

Line 50, "11" should read --1--.
Line 51, "shoe 1 1b" should read --shoe 11b--.

COLUMN 5

Line 11, "rotaton" should read --rotation--.
Line 66, "below" should read --below,--.

COLUMN 7

Line 15, "make" should read --makes--.
Line 23, "net" should read --not--.
Line 68, "27c" should read --27e--.

UNITED STATES PATENT AND TRADEMARK OFFICE

CERTIFICATE OF CORRECTION

PATENT NO. : 5,357,275

DATED : October 18, 1994

INVENTOR(S) : MASAHARU IKADO, ET AL.

It is certified that error appears in the above-identified patent and that said Letters Patent is hereby corrected as shown below:

COLUMN 10

Line 22, "which is" should be deleted.
Line 23, "3b" should read --3b which is--.

COLUMN 11

Line 32, "through" should be deleted.

COLUMN 12

Line 42, "begins" should read --begins to--.

COLUMN 13

Line 4, "made" should be deleted.

COLUMN 14

Line 37, "caping." should read --capping.--.

COLUMN 15

Line 14, "non-discharge" should read --non-discharge of--.

COLUMN 16

Line 50, "nucleus" should read --nucleate-- and
"point" should read --point,--.

UNITED STATES PATENT AND TRADEMARK OFFICE

CERTIFICATE OF CORRECTION

PATENT NO. : 5,357,275

DATED : October 18, 1994

INVENTOR(S) : MASAHARU IKADO, ET AL.

It is certified that error appears in the above-identified patent and that said Letters Patent is hereby corrected as shown below:

COLUMN 18

Line 11, "sectioning" should read --suctioning--.
Line 30, "of" should read --for--.
Line 39, "of" should read --for--.
Line 45, "of" should read --for--.

COLUMN 21

Line 13, "wherein," should read --wherein--.
Line 66, "32," should read --35,--.

COLUMN 22

Line 27, "of" should read --for--.
Line 35, "of" should read --for--.
Line 41, "of" should read --for--.

COLUMN 25

Line 2, "64," should read --55,--.

UNITED STATES PATENT AND TRADEMARK OFFICE

CERTIFICATE OF CORRECTION

PATENT NO. : 5,357,275

DATED : October 18, 1994

INVENTOR(S) : MASAHARU IKADO, ET AL.

It is certified that error appears in the above-identified patent and that said Letters Patent is hereby corrected as shown below:

COLUMN 26

Line 17, "gathering" should read --generating--.

Signed and Sealed this

Fifteenth Day of August, 1995

Bruce Lehman

*Attest:*

BRUCE LEHMAN

*Attesting Officer*

*Commissioner of Patents and Trademarks*